US005665500A

United States Patent [19]

Suzuki

[11] Patent Number: 5,665,500

[45] Date of Patent: Sep. 9, 1997

[54] ELECTROPHOTOGRAPHIC PHOTOCONDUCTOR

[75] Inventor: Yasuo Suzuki, Fuji, Japan

[73] Assignee: Ricoh Company, Ltd., Tokyo, Japan

[21] Appl. No.: 550,066

[22] Filed: Oct. 30, 1995

[30] Foreign Application Priority Data

| | | | |
|---|---|---|---|
| Oct. 31, 1994 | [JP] | Japan | 6-290468 |
| Feb. 2, 1995 | [JP] | Japan | 7-037651 |
| Oct. 24, 1995 | [JP] | Japan | 7-299099 |

[51] Int. Cl.[6] ..... G03G 5/04

[52] U.S. Cl. ..... 430/59; 430/66

[58] Field of Search ..... 430/70, 66, 83, 430/95, 59

[56] References Cited

U.S. PATENT DOCUMENTS

| | | | |
|---|---|---|---|
| 3,772,011 | 11/1973 | Guevara et al. | 430/66 |
| 4,925,757 | 5/1990 | Takenouchi et al. | 430/70 |
| 5,096,793 | 3/1992 | Osawa | 430/66 |

*Primary Examiner*—John Goodrow

*Attorney, Agent, or Firm*—Oblon, Spivak, McClelland, Maier & Neustadt, P.C.

[57] ABSTRACT

An electrophotographic photoconductor includes an electroconductive support and a photoconductive layer formed thereon, which photoconductive layer may be made of a charge generation layer containing a charge generating material and a charge transport layer containing a charge transporting material formed thereon, with a protective layer containing a charge transporting material optionally provided on top of the photoconductive layer, with any of the photoconductive layer, the charge transport layer or the protective layer, which constitutes a surface top layer of the photoconductor, having an oxygen transmission coefficient of $4.0\times10^{-11}$ $cm^3 \bullet cm/cm^2 \bullet s \bullet cmHg$ or less, and the charge transporting material for use in the surface top layer having a charge mobility of $1\times10^{-5cm\ 2}/V\bullet s$ or more at an electric field strength of $5\times10^5$ V/cm.

46 Claims, 1 Drawing Sheet

ELECTROPHOTOGRAPHIC PHOTOCONDUCTOR

BACKGROUND OF THE INVENTION

1. Field of the Invention

The present invention relates to an electrophotographic photoconductor, and more particularly to an electrophotographic photoconductor in which a surface top layer thereof has a specific oxygen transmission coefficient and contains a charge transporting material with a specific charge mobility.

2. Discussion of Background

Various inorganic materials such as Se, CdS and ZnO are conventionally employed as photoconductive materials for an electrophotographic photoconductor. However, because of poor photosensitivity, low thermal stability and toxicity of the above-mentioned inorganic materials, electrophotographic photoconductors employing organic photoconductive materials have been actively developed recent years, and in fact, a variety of organic photoconductors are applied to the commercially available copying machine and printer.

According to the Carlson process, the electrophotographic photoconductor is repeatedly subjected to a cycle of charging, exposure, development, transfer, quenching and cleaning in order to fulfill its functions. The photoconductor is therefore required to have high durability to constantly produce high quality images.

The organic photoconductor is required to have high durability in terms of its electrostatic properties in order to prevent the photosensitivity and charging characteristics from decreasing, the residual potential from increasing, and the image blur and toner deposition of background from occurring, as well as in terms of its mechanical properties in order to protect the surface of the photoconductor from wear and scratching.

To increase the mechanical durability of the photoconductor, a binder resin with high wear resistance has been studied, and the electrophotographic process has been reviewed so as to reduce the wear of the photoconductor.

On the other hand, it is known that the electrostatic properties of the photoconductor are decreased by the deposition of an oxidizing material such as ozone or $No_x$ generated by corona charging on the surface of the photoconductor, and the deterioration of a charge transporting material for use in the photoconductor. Due to the deposition of the oxidizing material on the surface of the photoconductor and deterioration of the charge transporting material, the surface resistivity of the photoconductor is decreased, thereby causing the blurring of obtained images. In addition, when the photoconductor is reused after intermission subsequent to repeated operations, white non-printed spots tend to appear in a solid image, or black stripes on a white background in the case of reversal development because of decrease of the charging properties.

The following proposals are conventionally made to solve the above-mentioned problems of defective images resulting from the deterioration of electrostatic properties of the photoconductor:

(1) Japanese Laid-Open Patent Applications 2-52373 and 3-92822.

There is proposed a method of constantly keeping the surface of a photoconductor in good condition by abrading the surface thereof.

However, this method necessitates an abrasive material, thereby increasing the cost, and the mechanical durability of the photoconductor is decreased.

(2) Japanese Laid-Open Patent Applications 2-64549, 2-64550 and 6-332216.

There is proposed a photoconductor of which photoconductive layer contains an antioxidant.

According to this method, the image blur due to the decrease of surface resistivity of the photoconductor cannot be prevented although the electrostatic durability of the photoconductor is improved.

(3) Japanese Laid-Open Patent Applications 2-67566, 2-189550 and 2-189551.

It is proposed to provide a protective layer comprising fluoroplastic particles on the photoconductive layer.

However, this method induces the decrease of photosensitivity. In addition, it is difficult to form a uniform smooth film of the protective layer, and the manufacturing cost of the photoconductor is increased.

(4) Japanese Laid-Open Patent Applications 1-284857, 1-285949 and 4-21855.

It is proposed that finely-divided particles of a lubricant be contained in a surface top layer of the photoconductor.

This method also induces the decrease of photosensitivity. It is absolutely necessary that the lubricant particles be present in the surface portion of the surface top layer, otherwise no effect will be expected.

(5) Japanese Laid-Open Patent Applications 1-191883, 1-206386 and 1-233474.

It is proposed that the photoconductor be heated to a predetermined temperature to maintain the charging characteristics and charge retention characteristics of the photoconductor in good conditions, especially under the circumstances of high temperature and humidity.

However, this method necessitates a heating member, thereby increasing the cost. There is a risk of the photoconductive layer being softened by the application of heat thereto.

As previously mentioned, the conventional proposals involve many problems, and there is no satisfactory photoconductor at the present stage.

SUMMARY OF THE INVENTION

Accordingly, it is a first object of the present invention to provide an electrophotographic photoconductor free from the above-mentioned conventional shortcomings, which can constantly produce high quality images without the occurrence of image blur, white non-printed spots in a solid image, black stripes in a white background, toner deposition of background while the photoconductor is repeatedly used.

A second object of the present invention is to provide an electrophotographic photoconductor with high resistance to gases such as ozone and $NO_x$.

A third object of the present invention is to provide an electrophotographic photoconductor with minimum variation of potential, that is, minimum increase in the potential of a light portion and minimum decrease in the potential of a dark portion on the photoconductor during the repeated operations.

The above-mentioned objects of the present invention can be achieved by an electrophotographic photoconductor comprising an electroconductive support, and a photoconductive layer formed thereon as a surface top layer of the photoconductor, the photoconductive layer comprising a charge generating material and a charge transporting material, and having an oxygen transmission coefficient of $4.0\times10^{-11}$ $cm^3 \bullet cm/cm^2 \bullet s \bullet cmHg$ or less, and the charge transporting material having a charge mobility of $1\times10^{-5}$ $cm^2/V \bullet s$ or more at an electric field strength of $5\times10^5$ V/cm.

Alternatively, the objects of the present invention can be achieved by an electrophotographic photoconductor comprising an electroconductive support, a photoconductive layer formed thereon which comprises a charge generation layer comprising a charge generating material, and a charge transport layer comprising a charge transporting material formed on the charge generation layer, serving as a surface top layer of the photoconductor, the charge transport layer having an oxygen transmission coefficient of $4.0\times10^{-11}$ $cm^3\bullet cm/cm^2\bullet s\bullet cmHg$ or less, and the charge transporting material having a charge mobility of $1\times10^{-5}$ $cm^2/V\bullet s$ or more at an electric field strength of $5\times10^5$ V/cm.

Furthermore, the objects of the present invention can be achieved by an electrophotographic photoconductor comprising an electroconductive support, a photoconductive layer formed thereon which comprises a charge generating material and a charge transporting material, and a protective layer comprising a charge transporting material formed on the photoconductive layer, serving as a surface top layer of the photoconductor, the protective layer having an oxygen transmission coefficient of $4.0\times10^{-11}$ $cm^3\bullet cm/cm^2\bullet s\bullet cmHg$ or less, and the charge transporting material for use in the protective layer having a charge mobility of $1\times10^{-5}$ $cm^2/V\bullet s$ or more at an electric field strength of $5\times10^5$ V/cm.

In any case, it is preferable that the surface top layer of the photoconductor have an oxygen transmission coefficient of $2.0\times10^{-11}$ $cm^3\bullet cm/cm^2\bullet s\bullet cmHg$ or less.

In addition, it is preferable that the surface top layer of the photoconductor further comprise a compound of formula (I):

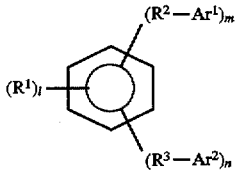

(I)

wherein $R^1$ is a lower alkyl group; $R^2$ and $R^3$ each is methylene group or ethylene group which may have a substituent; $Ar^1$ and $Ar^2$ each is an aryl group which may have a substituent; and l is an integer of 0 to 4, and each of m and n is an integer of 0 to 2 provided that $m+n\geqq2$ and $l+m+n\leqq6$.

Of the compounds represented by formula (I), the following compound of formula (II) is more preferable when used in the surface top layer:

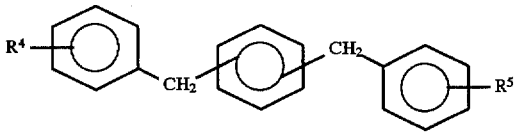

(II)

wherein $R^4$ or $R^5$ each is a lower alkyl group.

In any case, it is preferable that a charge transporting material for use in the surface top layer comprise a compound of formula (III):

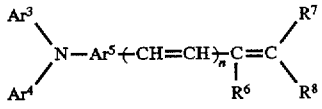

(III)

wherein $Ar^3$ and $Ar^4$ each is an aryl group which may have a substituent, or a heterocyclic group which may have a substituent; $R^6$, $R^7$ and $R^8$ each is a hydrogen atom, an alkyl group which may have a substituent, an alkoxyl group which may have a substituent, an aryl group which may have a substituent, or a heterocyclic group which may have a substituent, and $R^7$ and $R^8$ may form a ring in combination; $Ar^5$ is an arylene group which may have a substituent; and n is an integer of 0 or 1.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

The present invention will now be explained in detail by referring to FIG. 1 to FIG. 4.

Figure 1:
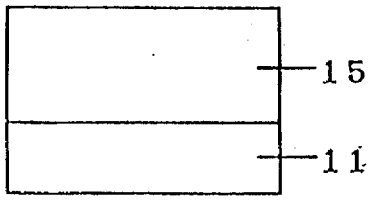
FIGS. 1 to 4 are schematic cross-sectional views of electrophotographic photoconductors of the present invention, in explanation of the structure of layers.

FIG. 1 is a schematic cross-sectional view of a first example of an electrophotographic photoconductor according to the present invention. As shown in FIG. 1, there is provided on an electroconductive support 11 a photoconductive layer 15 comprising a charge generating material and a charge transporting material.

Figure 2:
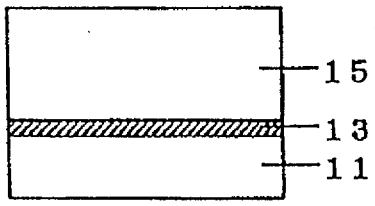

FIG. 2 is a schematic cross-sectional view of another example of an electrophotographic photoconductor according to the present invention. In an electrophotographic photoconductor of FIG. 2, an intermediate layer 13 is provided between an electroconductive support 11 and a photoconductive layer 15.

Figure 3:
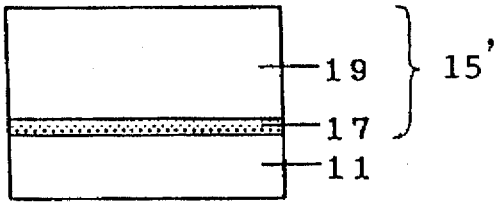

FIG. 3 is a schematic cross-sectional view of a further example of an electrophotographic photoconductor according to the present invention. In an electrophotographic photoconductor of FIG. 3, a photoconductive layer 15' is of a function-separating type, where a charge generation layer 17 and a charge transport layer 19 are successively overlaid in this order.

Figure 4:
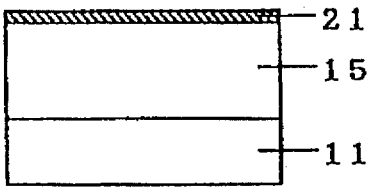

FIG. 4 is a schematic cross-sectional view of still another example of an electrophotographic photoconductor according to the present invention. In an electrophotographic photoconductor of FIG. 4, there are provided on an electroconductive support 11 a photoconductive layer 15 comprising a charge generating material and a charge transporting material, and a protective layer 21 comprising a charge transporting material.

According to the present invention, the photoconductive layer 15 has an oxygen transmission coefficient of $4.0\times10^{-11}$ $cm^3\bullet cm/cm^2\bullet s\bullet cmHg$ or less, and the charge transporting material has a charge mobility of $1\times10^{-5}$ $cm^2/V\bullet s$ or more at an electric field strength of $5\times10^5$ V/cm in the case of FIG. 1 or FIG. 2.

In the case of FIG. 3, the charge transport layer 19 has an oxygen transmission coefficient of $4.0\times10^{-11}$ $cm^3\bullet cm/cm^2\bullet s\bullet cmHg$ or less, and the charge transporting material for use in the charge transport layer 19 has a charge mobility of $1\times10^{-5}$ $cm^2/V\bullet s$ or more at an electric field strength of $5\times10^5$ V/cm.

As previously mentioned, the photoconductive layer of the electrophotographic photoconductor according to the present invention may be of a single-layered type as shown in FIGS. 1, 2 and 4, but preferably of a function-separating type. In particular, it is preferable that a charge transport layer be provided on a charge generation layer as shown in FIG. 3. The reason for this is that the charge generating material for use in the charge generation layer is easily reactive to the oxidizing gases such as ozone and $NO_x$. Therefore, when the charge generation layer is exposed, not coated by a resin film of the charge transport layer or the protective layer, the charge generation layer is vulnerable to the oxidizing gases, and the charging properties of the photoconductor are decreased.

For the preparation of the electroconductive support 11, an electroconductive material with a volume resistivity of $10^{10}$ Ω•cm or less, for example, metals such as aluminum, nickel, chromium, nichrome, copper, gold, silver, and platinum; or metallic oxides such as tin oxide and indium oxide may be coated on a support material such as a sheet of paper or a plastic film, which may be in the cylindrical form, by deposition or sputtering. Alternatively, a plate made of aluminum, aluminum alloys, nickel or stainless steel may be formed into a tube by extrusion or drawing, and then subjected to surface treatment such as cutting, superfinishing or abrasion to obtain an electroconductive support 11. Further, an endless nickel belt or endless stainless steel belt as disclosed in Japanese Laid-Open Patent Application 52-36016 may be used as the electroconductive support 11.

Furthermore, a coating liquid prepared by dispersing electroconductive particles in an appropriate binder resin may be coated on the above-mentioned support material to obtain the electroconductive support 11.

In this case, examples of the electroconductive particles are powders of carbon black and acetylene black; powders of metals such as aluminum, nickel, iron, nichrome, copper, zinc and silver; and powders of metallic oxides such as electroconductive titanium oxide, electroconductive tin oxide, and ITO.

Examples of the binder resin used in combination with the above-mentioned electroconductive particles for preparation of the electroconductive support 11 include thermoplastic resins, thermosetting resins and photosetting resins such as polystyrene, styrene—acrylonitrile copolymer, styrene—butadiene copolymer, styrene—maleic anhydride copolymer, polyester, polyvinyl chloride, vinyl chloride—vinyl acetate copolymer, polyvinyl acetate, polyvinylidene chloride, polyarylate resin, phenoxy resin, polycarbonate, cellulose acetate resin, ethyl cellulose resin, polyvinyl butyral, polyvinyl formal, polyvinyltoluene, poly-N-vinylcarbazole, acrylic resin, silicone resin, epoxy resin, melamine resin, urethane resin, phenolic resin, and alkyd resin.

The above-mentioned electroconductive particles and binder resins may be dispersed in a solvent such as tetrahydrofuran, dichloromethane, 2-butanone or toluene, and the dispersion thus obtained may be coated on the support material.

In addition, for the preparation of the electroconductive support 11, there may be provided on a cylindrical support material an electroconductive layer in such a manner that a heat-shrinkable tubing prepared by adding the above-mentioned electroconductive particles to a material such as polyvinyl chloride, polypropylene, polyester, polystyrene, polyvinylidene chloride, polyethylene, chlorinated rubber, or Teflon is formed on the cylindrical support material.

The photoconductive layer 15' of a function-separating type as shown in FIG. 3 will be now explained in detail.

The charge generation layer 17 may consist of a charge generating material, or may comprise a binder resin and a charge generating material dispersed in the binder resin. To prepare such a charge generation layer 17, the constituting components are dispersed in an appropriate solvent in a ball mill, attritor, sand mill or ultrasonic mill, and a coating liquid thus prepared is coated on the electroconductive support 11 or the intermediate layer 13, and dried.

Examples of the charge generating material for use in the charge generation layer 17 include phthalocyanine pigments such as a titanyl phthalocyanine pigment, a vanadyl phthalocyanine pigment, a copper phthalocyanine pigment, a hydroxygallium phthalocyanine pigment and a metal-free phthalocyanine pigment; azo pigments such as a monoazo pigment, a bisazo pigment, an asymmetric disazo pigment, a trisazo pigment and a tetraazo pigment; pyrrolopyrrole pigments; anthraquinone pigments; perylene pigments; polycyclic quinone pigments; indigo pigments; squarylium pigments; and Se alloys.

Examples of the binder resin for use in the charge generation layer 17 include polyamide, polyurethane, epoxy resin, polyketone, polycarbonate, silicone resin, acrylic resin, polyvinyl butyral, polyvinyl formal, polyvinyl ketone, polystyrene, polyvinylcarbazole, polyacrylamide, polyvinyl benzal, polyester, phenoxy resin, vinyl chloride—vinyl acetate copolymer, polyvinyl acetate, polyamide, polyvinyl pyridine, cellulose resin, casein, polyvinyl alcohol, and polyvinyl pyrrolidone.

It is preferable that the amount of the binder resin be in a range of 0 to 500 parts by weight, more preferably 10 to 300 parts by weight, to 100 parts by weight of the charge generating material in the charge generation layer 17. The thickness of the charge generation layer 17 is preferably in a range of 0.01 to 5 μm, more preferably 0.1 to 2 μm.

Examples of the solvent used for the preparation of the charge generation layer 17 include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene and ligroin.

The coating liquid for the formation of the charge generation layer 17 may be coated by dip coating, spray coating, bead coating, nozzle coating, spinner coating, or ring coating.

The charge transport layer 19 is provided on the charge generation layer 17 in such a manner that a charge transporting material and a binder resin are dissolved or dispersed in an appropriate solvent, and a coating liquid thus prepared is coated on the charge generation layer 17 and dried. The coating liquid for the charge transport layer 19 may further comprise a plasticizer, a leveling agent, and an antioxidant when necessary.

Examples of the charge transporting material for use in the charge transport layer 19 include carbazole and derivatives thereof, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, and enamine derivatives; and polymers comprising any of the above-mentioned derivatives; and polysilane. Those charge transporting materials may be used alone or in combination.

The charge transporting material for use in the charge transport layer 19 is required to have a charge mobility of $1\times10^{-5}$ $cm^2/V\bullet s$ or more at an electric field strength of $5\times10^5$ V/cm.

Examples of the binder resin used for the preparation of the charge transport layer 19 include thermoplastic or thermosetting resins such as polystyrene, styrene—acrylonitrile copolymer, styrene—butadiene copolymer, styrene—maleic anhydride copolymer, polyester, polyvinyl chloride, vinyl chloride—vinyl acetate copolymer, polyvinyl acetate, polyvinylidene chloride, polyarylate, phenoxy resin, polycarbonate, cellulose acetate resin, ethyl cellulose resin, polyvinyl butyral, polyvinyl formal, polyvinyl toluene, poly-N-vinylcarbazole, acrylic resin, silicone resin, epoxy resin, melamine resin, urethane resin, phenolic resin, alkyd resin, and various polycarbonate copolymers as disclosed in Japanese Laid-Open Patent Applications 5-158250 and 6-51544.

It is preferable that the amount of the charge transporting material be in a range of 20 to 300 parts by weight, more preferably 40 to 150 parts by weight, to 100 parts by weight of the binder resin in the charge transport layer 19. The thickness of the charge transport layer 19 is preferably in a range of about 5 to 50 μm.

Examples of the solvent used for the preparation of the charge transport layer 19 include tetrahydrofuran, dioxane, toluene, monochlorobenzene, dichloroethane, dichloromethane, cyclohexanone, methyl ethyl ketone and acetone.

When the plasticizer is added to the coating liquid for the charge transport layer 19, any plasticizers for general resins, such as dibutyl phthalate and dioctyl phthalate can be used as they are. In this case, it is proper that the amount of the plasticizer be in a range of 0 to 30 parts by weight to 100 parts by weight of the binder resin in the charge transport layer coating liquid.

As the leveling agent for use in the charge transport layer coating liquid, silicone oils such as dimethyl silicone oil and methylphenyl silicone oil, and polymers and oligomers having a perfluoroalkyl group on the side chain thereof can be employed. It is proper that the amount of the leveling agent be in a range of 0 to 1 part by weight to 100 parts by weight of the binder resin in the charge transport layer coating liquid.

Examples of the antioxidant for use in the charge transport layer coating liquid include hindered phenols, sulfur-containing compounds, phosphorus-containing compounds, hindered amines, pyridine derivatives, piperidine derivatives, morpholine derivatives and hydroquinone compounds. It is proper that the amount of the antioxidant be in a range of 0 to 5 parts by weight to 100 parts by weight of the binder resin in the charge transport layer coating liquid.

The electrophotographic photoconductor comprising a single-layered photoconductive layer as shown in FIGS. 1, 2, and 4 will now be described in detail.

In the single-layered photoconductive layer 15, the same charge generating materials and charge transporting materials as previously mentioned are contained and they carry out their functions separately.

To obtain the single-layered photoconductive layer 15, a charge generating material, a charge transporting material and a binder resin are dissolved or dispersed in a proper solvent, for example, tetrahydrofuran, dioxane, dichloroethane, cyclohexanone or dichloromethane, and a coating liquid thus prepared is coated on the electroconductive support 11 or the intermediate layer 13 by dip coating, spray coating or bead coating, and dried.

When necessary, the coating liquid for the photoconductive layer 15 may further comprise a plasticizer, a leveling agent and an antioxidant.

For the preparation of the coating liquid for the single-layered photoconductive layer 15, the same binder resins as those used for the formation of the charge transport layer 19 can be employed alone or in combination with the same binder resins as those used for the formation of the charge generation layer 17.

In addition, a single-layered photoconductive layer 15 can also be prepared by adding a positive-hole transporting material to a eutectic complex of a pyrylium dye and a bisphenol type polycarbonate.

It is proper that the thickness of the single-layered photoconductive layer 15 be in a range of about 5 to 50 μm.

In the present invention, the intermediate layer 13 may be interposed between the electroconductive support 11 and the photoconductive layer 15 as illustrated in FIG. 2. The intermediate layer 13 mainly comprises a resin or a mixture of a resin and finely-divided particles of a metallic oxide pigment dispersed in the resin. When consideration is given to the formation of the single-layered photoconductor 15 on the intermediate layer 13 using a solvent, a resin with high resistance to general organic solvents is preferably employed for the intermediate layer 13.

Examples of such a resin for use in the intermediate layer 13 include water-soluble resins such as polyvinyl alcohol, casein and sodium polyacrylate; alcohol-soluble resins such as copolymer nylon and methoxymethylated nylon; ethylenic resins such as ethylene—vinyl acetate copolymer, ethylene—vinyl acetate—maleic anhydride copolymer and ethylene—vinyl acetate—methacrylic acid copolymer; vinyl chloride resins such as vinyl chloride—vinyl acetate copolymer and vinyl chloride—vinyl acetate—maleic anhydride copolymer; curing resins capable of forming a three-dimensional network structure, such as celullose derivative resin, polyurethane, melamine resin, phenolic resin, alkyd—melamine resin, acryl—melamine resin, silicone resin, silicone—alkyd resin, epoxy resin, and polyisocyanate compound.

Furthermore, the intermediate layer 13 may comprise finely-divided particles of metallic oxide pigments such as titanium oxide, aluminum oxide, silica, zirconium oxide, tin oxide, and indium oxide in order to prevent the occurrence of Moiré and to decrease the residual potential of the photoconductor.

For the preparation of the intermediate layer 13, a silane coupling agent, titanium coupling agent, chromium coupling agent, titanyl chelate compound, zirconium chelate compound, titanyl alkoxide compound and organic titanyl compound can also be employed.

To provide the intermediate layer 13, the aforementioned components constituting the intermediate layer 13 may be dispersed in a proper solvent, and the coating liquid thus prepared may be coated on the electroconductive support 11 by the same manner as in the preparation of the photoconductive layer 15.

Alternatively, the intermediate layer 13 can also be obtained by anodizing of $Al_2O_3$ or vacuum deposition of an organic material such as polyparaxylylene and an inorganic material such as $SiO_2$, $SnO_2$, $TiO_2$, ITO, or $CeO_2$.

The proper thickness of the intermediate layer 13 is in a range of 0 to 10 μm.

In the present invention, as illustrated in FIG. 4, the protective layer 21 may be provided as a surface top layer on the photoconductive layer 15 to improve the durability of the photoconductor. Such a protective layer 21 can be provided by dissolving or dispersing a charge transporting material and a binder resin in a proper solvent and coating the thus prepared coating liquid on the photoconductive layer 15 and dried.

In such a case, the oxygen transmission coefficient of the protective layer 21 is $4.0\times10^{-11}$ $cm^3 \bullet cm/cm^2 \bullet s \bullet cmHg$ or less. The same charge transporting materials as previously mentioned, which have a charge mobility of $1\times10^{-5}$ $cm^2/V \bullet s$ or more at an electric field strength of $5\times10^5$ V/cm are used in the protective layer 21.

Examples of the binder resin for use in the protective layer 21 are ABS resin, chlorinated polyethylene—acrylonitrile—styrene (ACS) resin, copolymer of olefin and vinyl monomer, chlorinated polyether, allyl resin, phenolic resin, polyacetal, polyamide, polyamideimide, polyacrylate, polyallyl sulfone, polybutylene, polybutylene terephthalate, polycarbonate, polyether sulfone, polyethylene, polyethylene terephthalate, polyimide, acrylic resin, polymethyl pentene, polypropylene, polyphenylene oxide, polysulfone, polystyrene, styrene—acrylonitrile (AS) resin, butadiene—styrene copolymer, polyurethane, polyvinyl chloride, polyvinylidene chloride, and epoxy resin.

It is preferable that the amount of the charge transporting material be in a range of 30 to 100 parts by weight to 100 parts by weight of the binder resin in the protective layer 21.

To improve the wear resistance of the protective layer 21, fluoroplastics such as polytetrafluoroethylene, silicone resin, and inorganic materials such as titanium oxide, tin oxide and potassium titanate may be contained in the protective layer 21.

The protective layer 21 can be provided by any of the conventional coating methods, and the thickness of the protective layer 21 is preferably in a range of 0.5 to 10 μm.

Furthermore, an undercoat layer (not shown) may be provided between the photoconductive layer 15 and the protective layer 21. The undercoat layer comprises as the main component a resin, such as polyamide, alcohol-soluble nylon resin, water-soluble butyral resin, polyvinyl butyral, and polyvinyl alcohol.

The undercoat layer can also be provided by any of the conventional coating methods, and the thickness of the undercoat layer is preferably in a range of 0.05 to 2 μm.

In the electrophotographic photoconductor of the present invention, the oxygen transmission coefficient of the surface top layer, that is, the photoconductive layer 15 in FIGS. 1 and 2, the charge transport layer 19 in FIG. 3, and the protective layer 21 in FIG. 4, is $4.0\times10^{-11}$ $cm^3 \bullet cm/cm^2 \bullet s \bullet cmHg$ or less, and at the same time, the charge transporting material for use in the surface top layer has a charge mobility of $1\times10^{-5}$ $cm^2/V \bullet s$ or more at an electric field strength of $5\times10^5$ V/cm.

When the oxygen transmission coefficient of the surface top layer of the photoconductor is within the above-mentioned range, the surface top layer is regarded as very close to such a degree that it can substantially prevent the oxidizing gases such as ozone and $NO_x$ from passing through the photoconductor.

When the oxygen transmission coefficient of the surface top layer of the photoconductor exceeds $4.0\times10^{-11}$ $cm^3 \bullet cm/cm^2 \bullet s \bullet cmHg$, the ozone and $NO_x$ easily pass through the surface top layer of the photoconductor, so that the deterioration of the charge transporting material for use in the surface top layer by oxidation is inevitable. As a result, the electrostatic properties of the photoconductor deteriorate, thereby causing defective images, for example, black spots in the images in the case of reversal development. In addition, an ionic material is generated in the surface top layer by the reaction between the oxidizing gases passing through the surface top layer and a water component, and therefore, the resistivity of the surface top layer is reduced. This induces the phenomenon of image blur.

Even when the oxygen transmission coefficient of the surface top layer of the photoconductor is $4.0\times10^{-11}$ $cm^3 \bullet cm/cm^2 \bullet s \bullet cmHg$ or less, it is inevitable that the charge transporting material existing in a most surface portion of the surface top layer be subjected to the oxidizing gases such as ozone and $NO_x$ to produce defective images such as image blur.

However, it is found that the objects of the present invention can be attained when the surface top layer of the photoconductor has an oxygen transmission coefficient of $4.0\times10^{-11}$ $cm^3 \bullet cm/cm^2 \bullet s \bullet cmHg$ or less, and at the same time, the charge transporting material with a charge mobility of $1\times10^{-5}$ $cm^2/V \bullet s$ or more at an electric field strength of $5\times10^5$ V/cm is employed in the surface top layer. The reason for this has not been clarified, but it is known that there are scattered non-localized electrons in a charge transporting material of which mobility is as high as $1\times10^{-5}$ $cm^2/V \bullet s$ or more at an electric field strength of $5\times10^5$ V/cm, and the fluorescence efficiency of such a charge transporting material is large. It is therefore supposed that the charge transporting material with a high charge mobility is less reactive to the oxidizing gases because excitation energy of the charge transporting material is readily shifted, and effectively dissipated by irradiation of fluorescence when the charge transporting material is in an excited state or at the precursory stage of reaction. As previously mentioned, the reactivity of such a charge transporting material with a high charge mobility to the oxidizing gases such as ozone and $NO_x$ is very small, and they are not susceptible to those gases.

Furthermore, it is preferable that the oxygen transmission coefficient of the surface top layer of the photoconductor be $2.0\times10^{-11}$ $cm^3 \bullet cm/cm^2 \bullet s \bullet cmHg$ or less in order to more effectively prevent the oxidizing gases such as ozone and $NO_x$ from passing through the surface top layer of the photoconductor.

The methods for measuring the oxygen transmission coefficient of a surface top layer of the photoconductor, and the charge mobility of a charge transporting material will now be described in detail.

1. Oxygen Transmission Coefficient

A coating liquid with a predetermined formulation for a surface top layer such as a photoconductive layer, a charge transport layer or a protective layer is coated on the smooth surface of a polyethylene terephthalate film, and dried under such conditions as stated in Examples to provide a layer with a thickness of 25 to 30 μm. The layer thus obtained is peeled from the polyethylene terephthalate film, and the oxygen transmission rate of the layer is obtained using a commercially available gas transmission rate measuring apparatus "Model M-C3" (Trademark), made by Toyo Seiki Seisakusho, Ltd. Then, the coefficient of oxygen transmission is obtained from the oxygen transmission rate. The method and conditions for measuring the oxygen transmission rate of the layer are as follows:

[Measuring Method]

Differential pressure method specified in the Japanese Industrial Standard, JIS K 7126 (Testing Method for Gas Transmission Rate through Plastic Film and Sheeting).

[Measuring Conditions]

Gas employed: oxygen as specified in the Japanese Industrial Standard JIS K 1101

Test temperature: 23±0.5° C.

Pressure: 760 mmHg

Oxygen transmission area: 38.46 $cm^2$ (ϕ70 mm)

2. Charge Mobility

The charge mobility of a charge transporting material is measured in accordance with the conventional time-of-flight method, for example, as described in J. Appl. Phys. 71, 300 (1992).

[Configuration of Measuring Apparatus]

Substrate: Glass substrate

Anode: Aluminum-deposited film

Cathode: Gold-deposited film

Charge transport layer: Layer comprising a charge transporting material/a commercially available polycarbonate (Trademark "Panlite K-1300", made by Teijin Chemicals Ltd.) at a mixing ratio by weight of 8/10, with a thickness of 7 to 8 μm.

Light source: Nitrogen gas laser applied from the anode side thereof.

Electric field strength: $5\times10^5$ V/cm.

Logt–LogV plotting is performed from the time (t)–voltage (V) waveform of the time-of-flight obtained by use of the above sample in accordance with the above method, and the charge mobility thereof is calculated from the value of an inflection point of the waveform.

The previously mentioned oxygen transmission coefficient of a surface top layer, that is, the photoconductive layer, the charge transport layer, or the protective layer, can also be obtained by peeling the corresponding layer from the obtained photoconductor.

In the present invention, it is preferable that the surface top layer of the photoconductor further comprise a compound of formula (I):

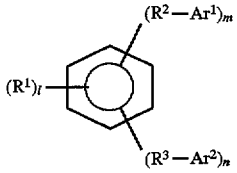

(I)

wherein $R^1$ is a lower alkyl group; $R^2$ and $R^3$ each is methylene group or ethylene group which may have a substituent; $Ar^1$ and $Ar^2$ each is an aryl group which may have a substituent; and l is an integer of 0 to 4 and each of m and n is an integer of 0 to 2 provided that $m+n\geqq2$ and $l+m+n\leqq6$.

As the lower alkyl group represented by $R^1$ in the formula (I), an alkyl group having 1 to 6 carbon atoms, for example, methyl group or ethyl group is preferably employed.

Specific examples of the substituent of methylene group or ethylene group represented by $R^2$ or $R^3$ are an alkyl group such as methyl group or ethyl group, an aralkyl group such as benzyl group, and an aryl group such as phenyl group. $R^2$ and $R^3$ may be the same or different.

Examples of the aryl group represented by $Ar^1$ or $Ar^2$ are phenyl group, biphenyl group and naphthyl group. Examples of the substituent of the above-mentioned aryl group include an alkyl group such as methyl group, ethyl group or propyl group, and an aralkyl group such as benzyl group. $Ar^1$ and $Ar^2$ may be the same or different.

Specific examples of the compound of formula (I) are as follows:

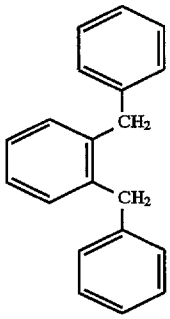

(I)-1

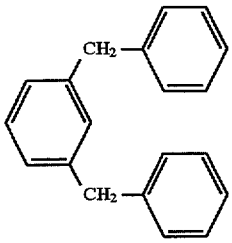

(I)-2

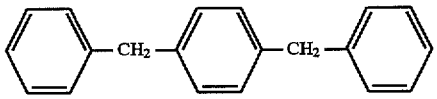

(I)-3

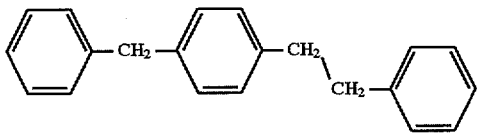

(I)-4

-continued
(I)-5
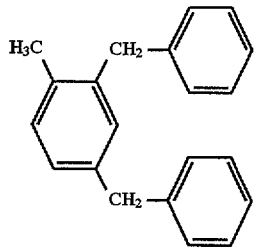
(I)-6
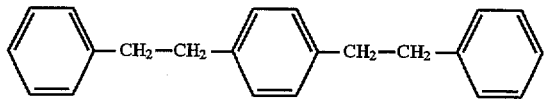
(I)-7
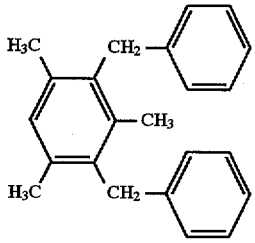
(I)-8
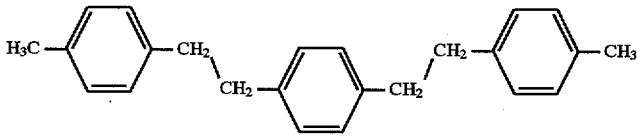
(I)-9
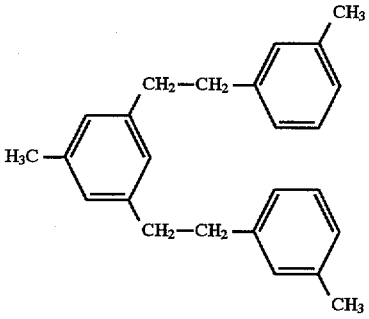
(I)-10
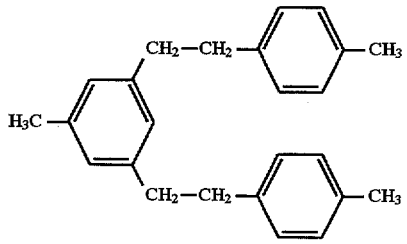
(I)-11
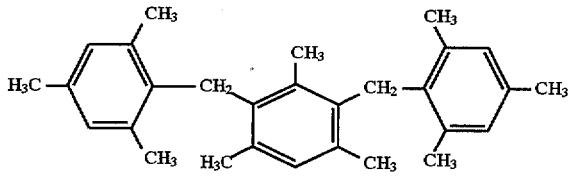

-continued
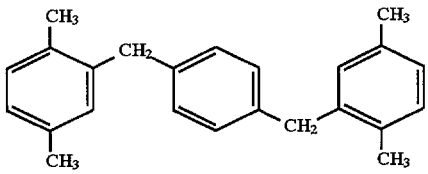
(I)-12
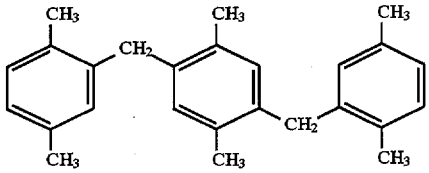
(I)-13
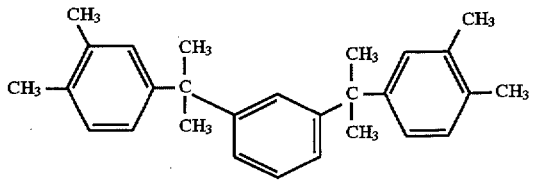
(I)-14
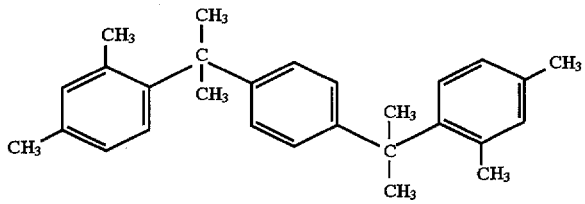
(I)-15
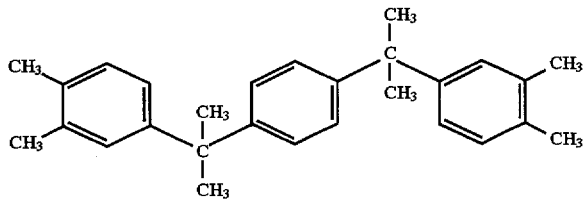
(I)-16
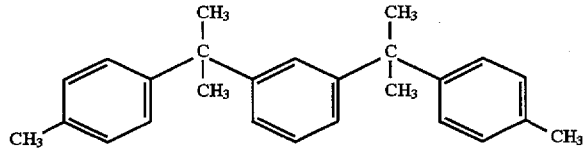
(I)-17
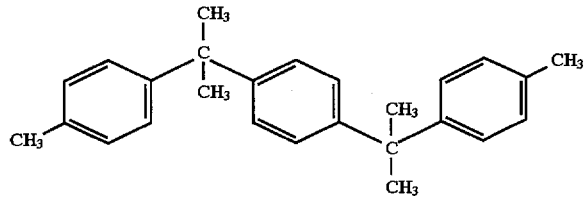
(I)-18
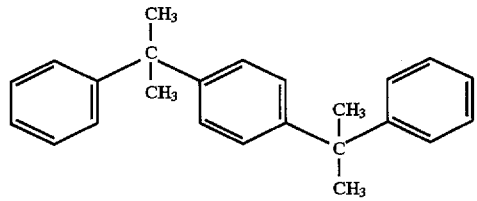
(I)-19

-continued
(I)-20
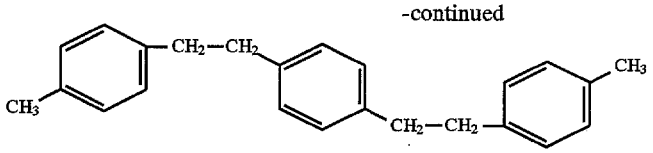
(I)-21
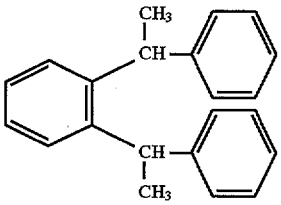
(I)-22
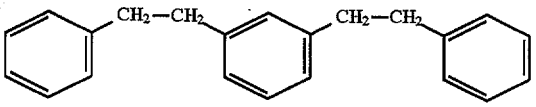
(I)-23
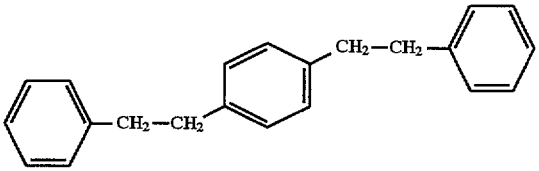
(I)-24
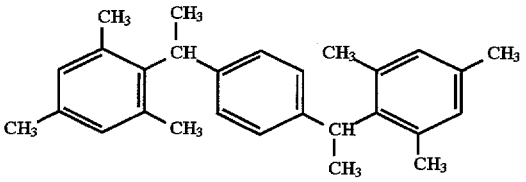
(I)-25
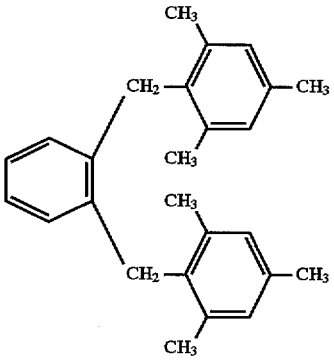
(I)-26
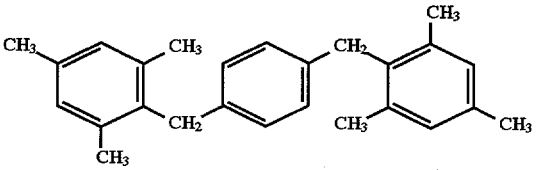
(I)-27
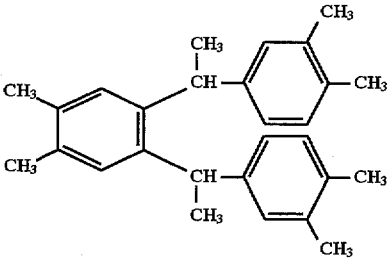

-continued
(I)-28
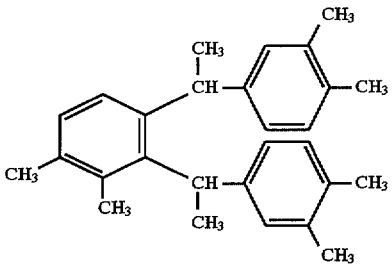
(I)-29
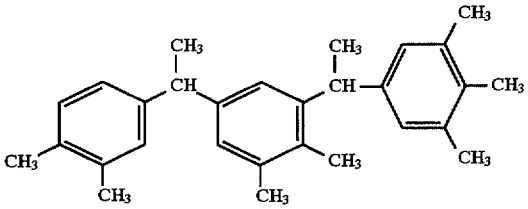
(I)-30
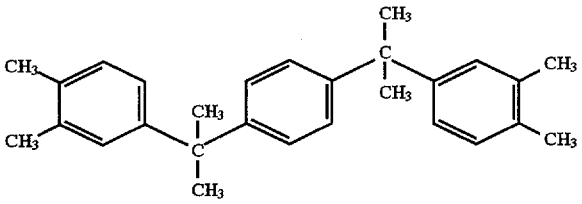
(I)-31
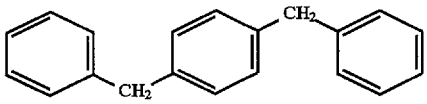
(I)-32
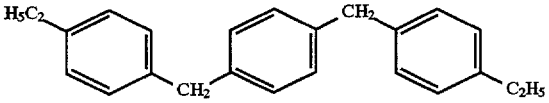
(I)-23
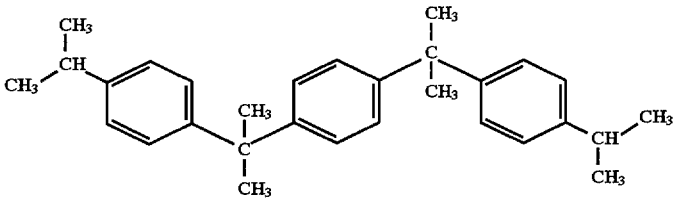
(I)-34
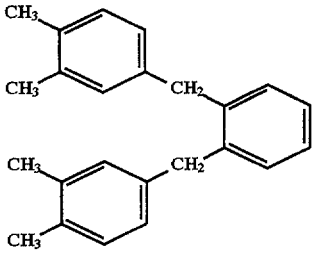
(I)-35
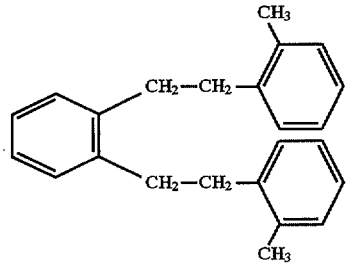

-continued
(I)-36
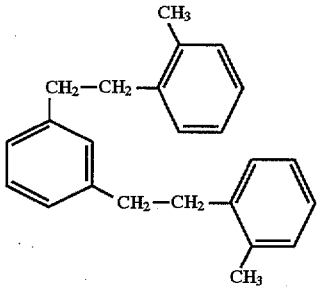
(I)-37
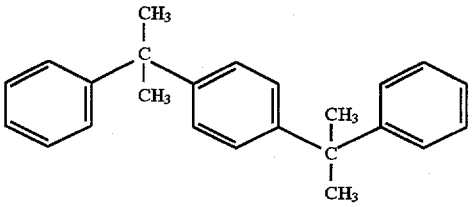
(I)-38
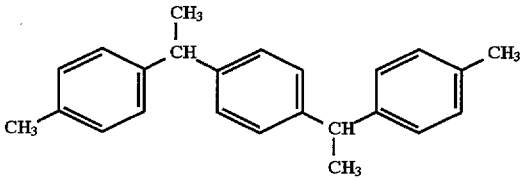
(I)-39
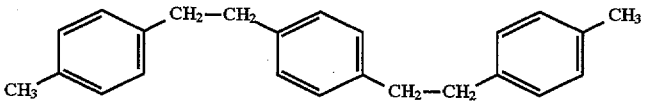
(I)-40
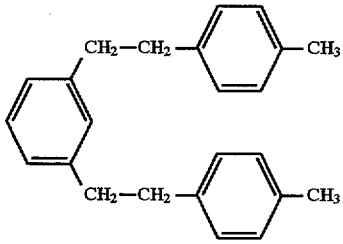
(I)-41
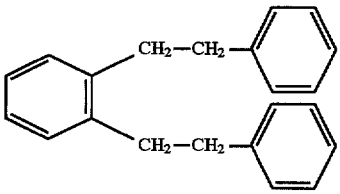
(I)-42
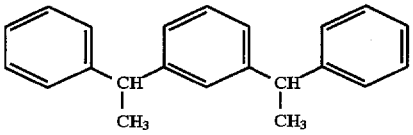
(I)-43
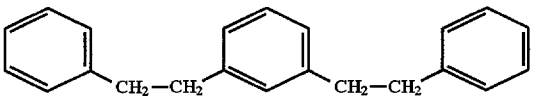

-continued
(I)-44
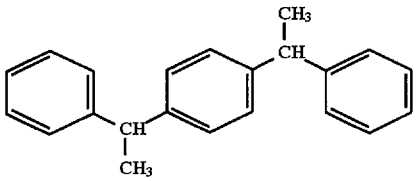
(I)-45
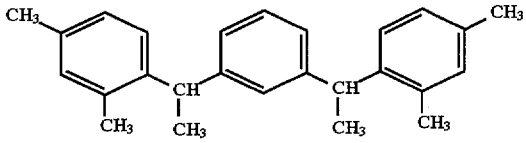
(I)-46
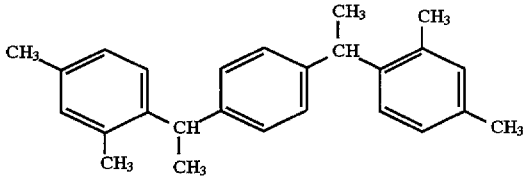
(I)-47
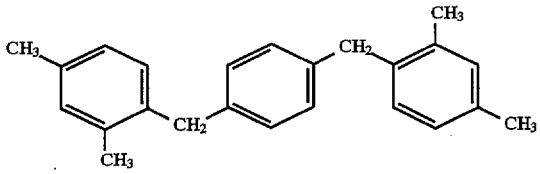
(I)-48
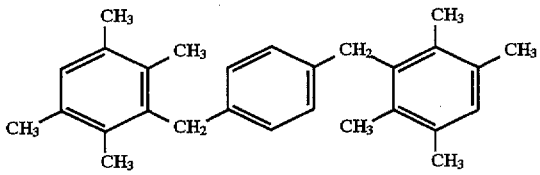
(I)-49
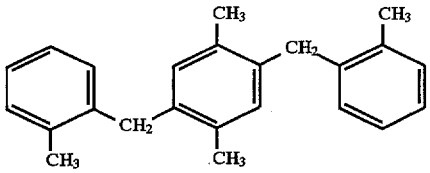
(I)-50
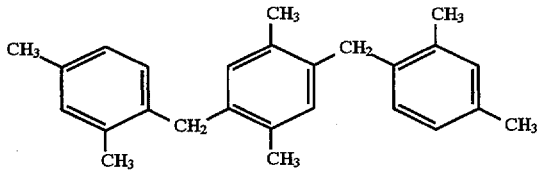
(I)-51
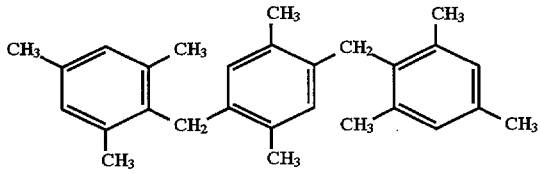
(I)-52
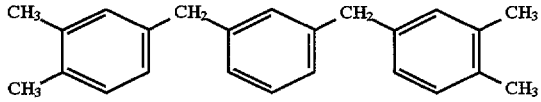

-continued
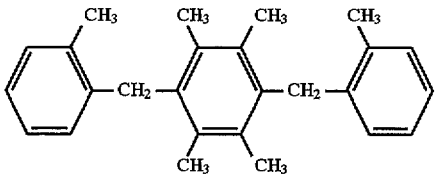
(I)-53
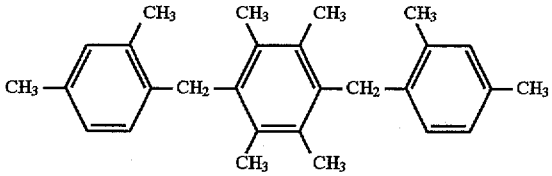
(I)-54
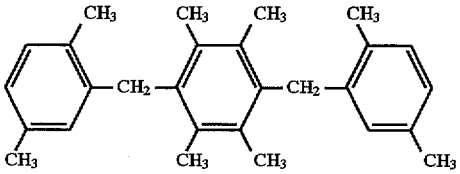
(I)-55
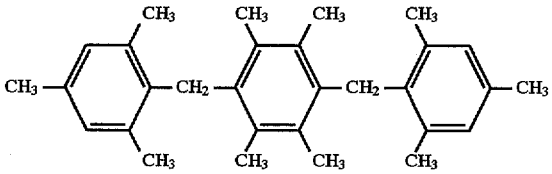
(I)-56
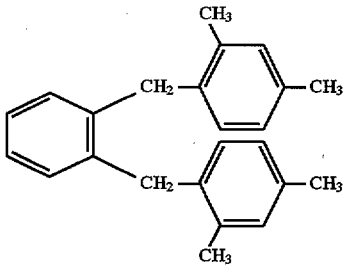
(I)-57
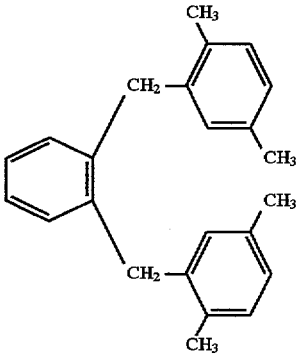
(I)-58

-continued
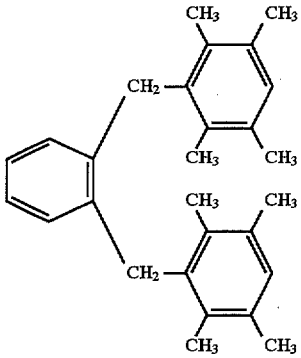
(I)-59
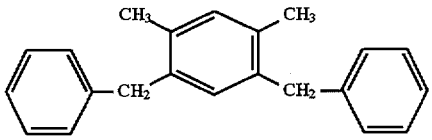
(I)-60
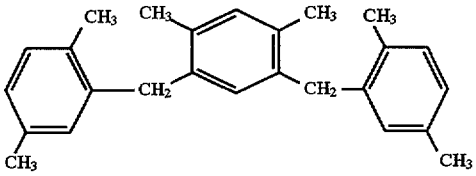
(I)-61
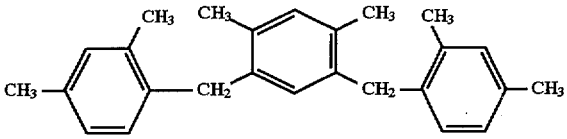
(I)-62
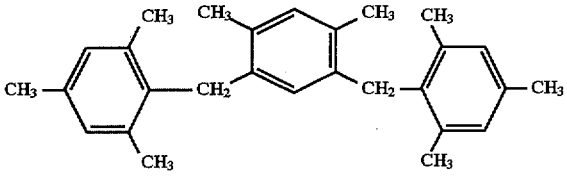
(I)-63
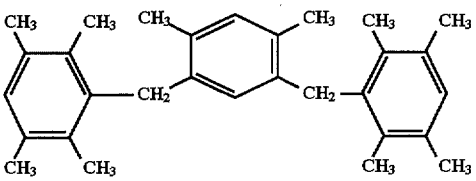
(I)-64
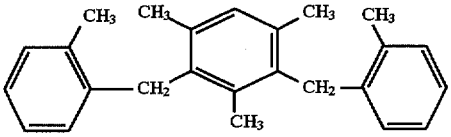
(I)-65
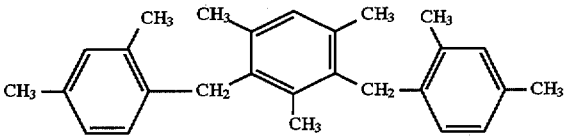
(I)-66

-continued
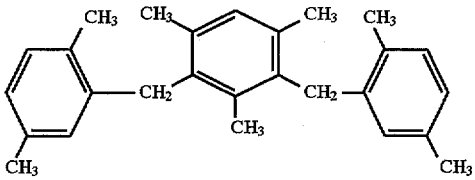
(I)-67
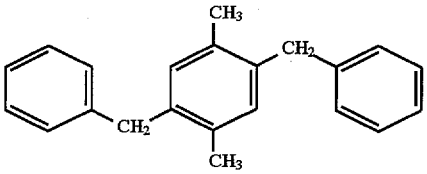
(I)-68
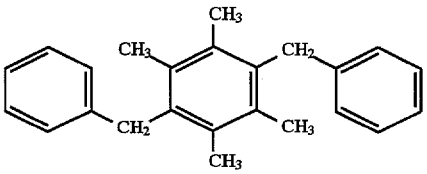
(I)-69
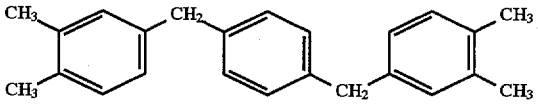
(I)-70
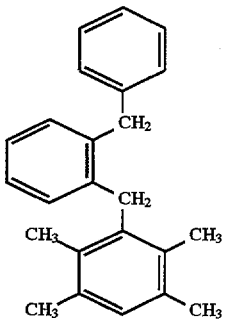
(I)-71
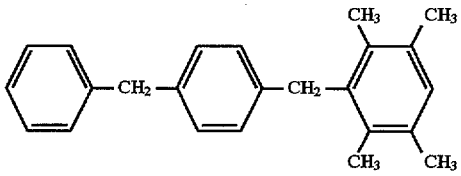
(I)-72
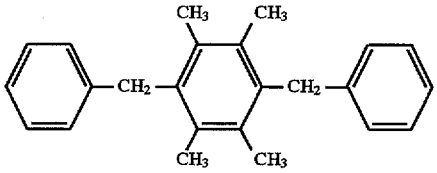
(I)-73
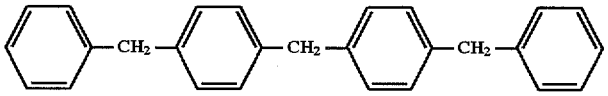
(I)-74
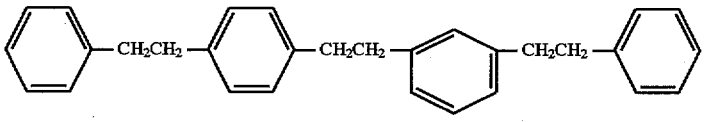
(I)-75

-continued
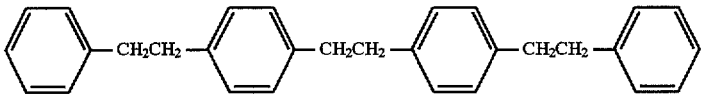
(I)-76
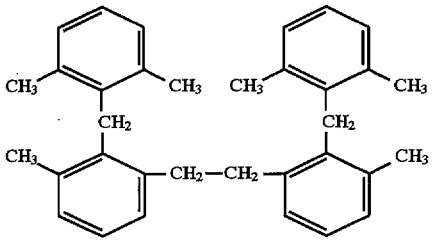
(I)-77
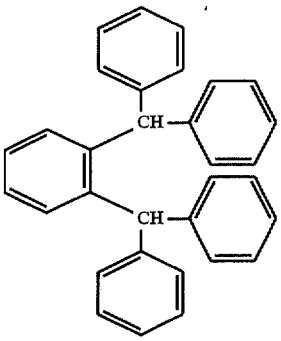
(I)-78
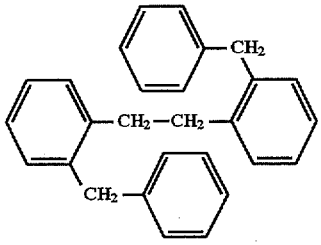
(I)-79
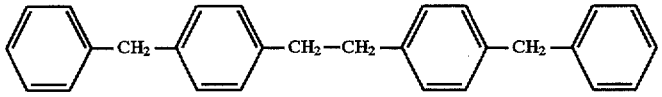
(I)-80
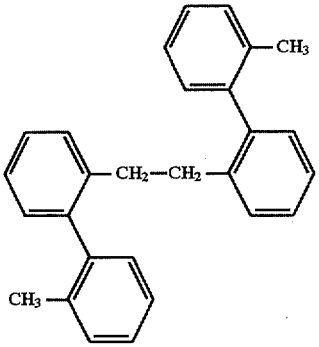
(I)-81

-continued
(I)-82
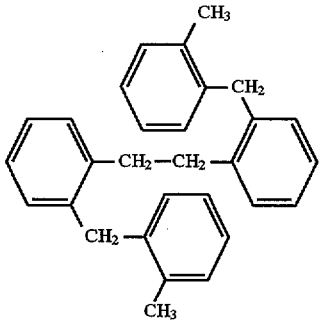
(I)-83
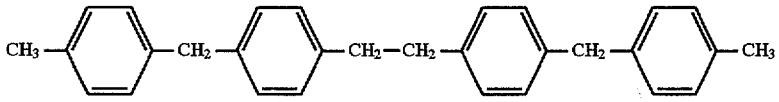
(I)-84
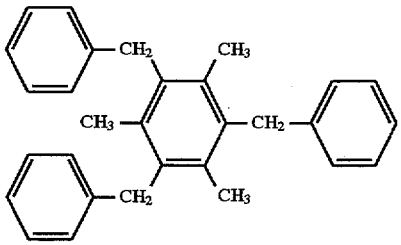
(I)-85
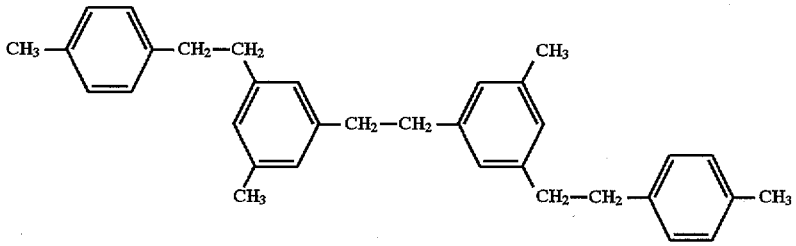
(I)-86
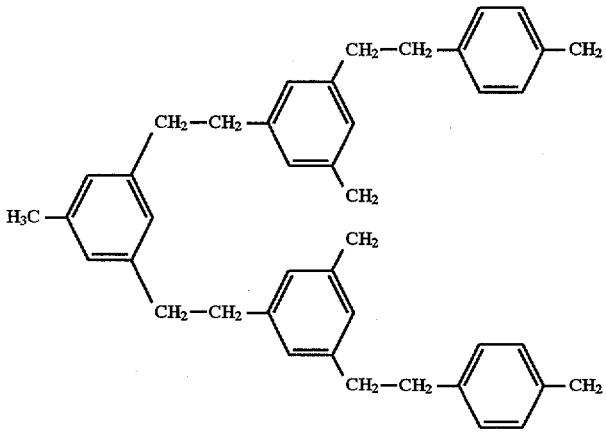
(I)-87
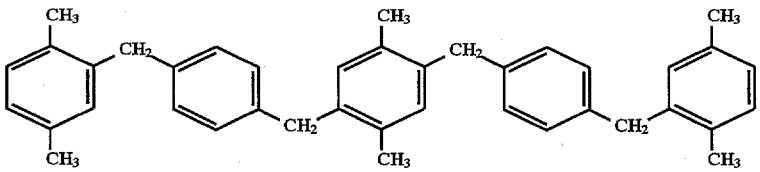

-continued (I)-88

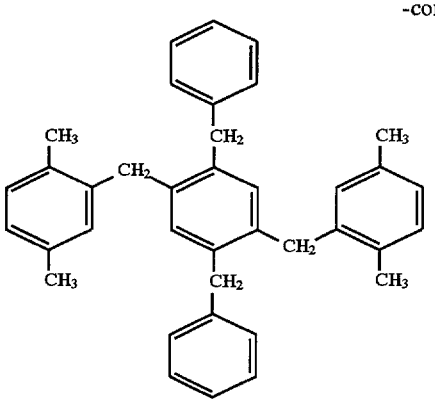

Of the compounds of formula (I), the compound represented by the following formula (II) is more preferable when the effects obtained by the addition of the compound of formula (I) to the surface top layer of the photoconductor is taken into consideration:

(II)

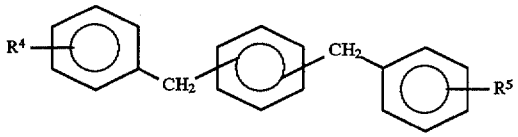

wherein $R^4$ and $R^5$ each is a lower alkyl group.

As the lower alkyl group represented by $R^4$ or $R^5$ in the above-mentioned formula (II), an alkyl group having 1 to 6 carbon atoms, such as methyl group or ethyl group is preferably employed.

The compound of formula (I) is prepared in such a manner that a chloroalkyl derivative and a hydrocarbon corresponding to the compound to be obtained are dissolved in nitromethane, and the mixture is stirred with the addition of a catalyst such as $ZnCl_2$ or $AlCl_3$ in a stream of nitrogen to carry out the reaction at a constant temperature.

The reason why the gas resistance of the photoconductor can be improved by the addition of the compound of formula (I) has not been clarified, but it is considered that minute air gaps existing in the surface top layer of the photoconductor can be decreased by the addition of the compound of formula (I) to the surface top layer, thereby reducing the gas transmission rate of the surface top layer. It is also considered that variation of the electric potential of the photoconductor and deterioration of obtained images during the repeated operations can be effectively prevented from the same reason as previously mentioned. Further, by the addition of the compound of formula (I), the compatibility of the components constituting the surface top layer can be improved, thereby preventing the aggregation of the constituting components, and the crystallization of an organic material. As a result, occurrence of pin-holes can be prevented, so that defective images are not formed.

In the photoconductor of the present invention, the compound of formula (I) may be contained in the photoconductive layer 15 as shown in FIGS. 1 or 2; in the charge transport layer 19 as shown in FIG. 3; or in the protective layer 21 as shown in FIG. 4.

When the photoconductive layer 15 comprises the compound of formula (I), it is preferable that the amount of the compound of formula (I) be in a range of 5 to 40 parts by weight to 100 parts by weight of the binder resin for use in the photoconductive layer 15. When the charge transport layer 19 comprises the compound of formula (I), it is preferable that the amount of the compound of formula (I) be in a range of 5 to 40 parts by weight to 100 parts by weight of the binder resin for use in the charge transport layer 19. In addition, when the protective layer 21 comprises the compound of formula (I), it is preferable that the amount of the compound of formula (I) be in a range of 5 to 20 parts by weight to 100 parts by weight of other constituting components of the protective layer 21. When the amount of the compound of formula (I) is within the above-mentioned range, the previously mentioned effects by the addition of the compound of formula (I) can be efficiently obtained, and at the same time, deterioration of the electrostatic properties such as decrease of photosensitivity can be prevented and the mechanical strength of the surface top layer to which the compound of formula (I) is added can be prevented.

In the present invention, when a plasticizer such as o-terphenyl is contained in the surface top layer of the photoconductor, the gas resistance of the photoconductor can be improved without the decrease of photosensitivity. In addition, the gas resistance of the photoconductor can also be improved by using a Z type polycarbonate as a binder resin for use in the surface top layer of the photoconductor.

Furthermore, it is preferable that the charge transporting material for use in the surface top layer of the photoconductor comprise a compound of formula (III):

(III)

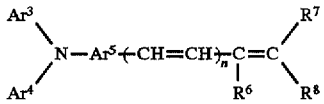

wherein $Ar^3$ and $Ar^4$ each is an aryl group which may have a substituent, or a heterocyclic group which may have a substituent; $R^6$, $R^7$ and $R^8$ each is a hydrogen atom, an alkyl group which may have a substituent, an alkoxyl group which may have a substituent, an aryl group which may have a substituent, or a heterocyclic group which may have a substituent, and $R^7$ and $R^8$ may form a ring in combination; $Ar^5$ is an arylene group which may have a substituent; and n is an integer of 0 or 1.

Examples of aryl group represented by $Ar^3$, $Ar^4$, $R^6$, $R^7$ or $R^8$ are phenyl group, naphthyl group, anthryl group, and pyrenyl group.

Examples of heterocyclic group represented by $Ar^3$, $Ar^4$, $R^6$, $R^7$ or $R^8$ are pyridyl group, pyrimidyl group, pyrazinyl group, triazinyl group, furyl group, pyrrolyl group, thienyl group, quinolyl group, thiazolyl group, carbazolyl group, benzimidazolyl group, benzothiazolyl group, coumarinyl group, benzofuranyl group, indolyl group, pyrazolyl group, imidazolyl group, oxazolyl group, thiazolyl group, benzotetrahydrofuryl group, and fluorenyl group.

The alkyl group represented by $R^6$, $R^7$ or $R^8$ is a straight chain or branched chain alkyl group having 1 to 6 carbon atoms, preferably 1 to 4 carbon atoms. Examples of the alkyl group are methyl group, ethyl group, n-propyl group, i-propyl group, t-butyl group, i-butyl group and n-butyl group.

The alkoxyl group represented by $R^6$, $R^7$ or $R^8$ has 1 to 6 carbon atoms, preferably 1 to 4 carbon atoms. Examples of the alkoxyl group are methoxy group, i-propoxy group, n-propoxy group, t-butoxy group, n-butoxy group, s-butoxy group and i-butoxy group.

Examples of arylene group represented by $Ar^5$ are phenylene group, naphthylene group, anthrylene group, pyrenylene group, biphenylene group, fluorenylene group and pyridylene group.

Examples of the substituent of aryl group, heterocyclic group, alkyl group, alkoxyl group or arylene group in formula (III) include fluorine atom, hydroxyl group, cyano group, an alkyl group having 1 to 4 carbon atoms, an alkoxyl group having 1 to 4 carbon atoms, a phenyl group which may be substituted by an alkyl group or an alkoxyl group, a halogen atom, benzyl group, and amino group.

The advantages of the above-mentioned compound of formula (III) is that the charge mobility of the compound is $1\times10^{-5}$ $cm^2/V\bullet s$ or more at an electric field strength of $5\times10^5$ V/cm, and the light-resistance and the compatibility with the binder resin are excellent.

Specific examples of the compound of formula (III) are shown in Table 1, but not limited to those compounds:

TABLE 1
| Compound No. | $Ar^3$ | $Ar^4$ | $Ar^5$ | $R^6$ | $R^7$ | $R^8$ |
|---|---|---|---|---|---|---|
| III-1 | 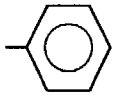 | 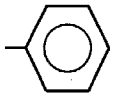 | 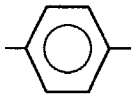 | −H | −H | 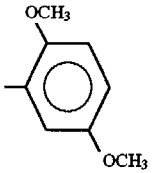  |
| III-2 | 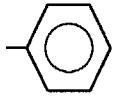 | 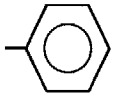 | 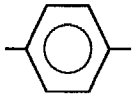 | −H | −H | 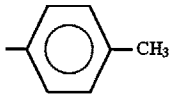  |
| III-3 | 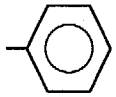 | 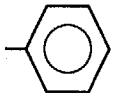 | 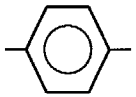 | −H | −H | 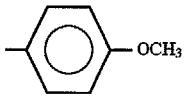  |
| III-4 | 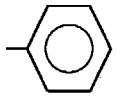 | 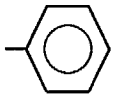 | 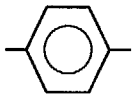 | −H | −H | 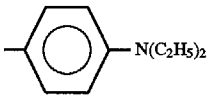  |
| III-5 | 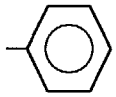 | 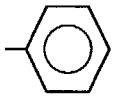 | 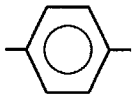 | −H | 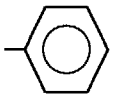 | 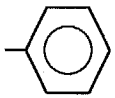 |
| III-6 | 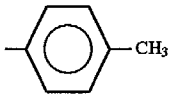  | 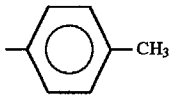  | 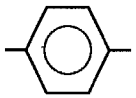 | −H | 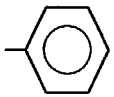 | 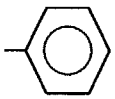 |
| III-7 | 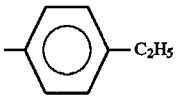  | 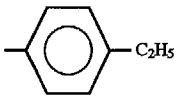  | 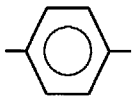 | −H | 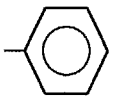 | 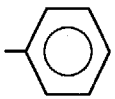 |
| III-8 | 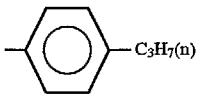  | 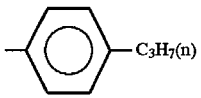  | 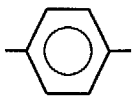 | −H | 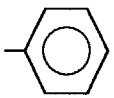 | 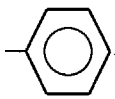 |

TABLE 1-continued
| Compound No. | $Ar^3$ | $Ar^4$ | $Ar^5$ | $R^6$ | $R^7$ | $R^8$ |
|---|---|---|---|---|---|---|
| III-9 | 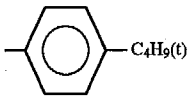 | 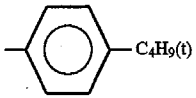 | 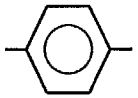 | −H | 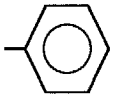 | 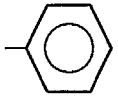 |
| III-10 | 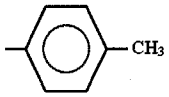 | 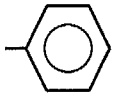 | 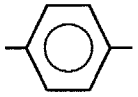 | −H | 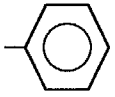 | 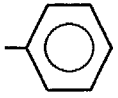 |
| III-11 | 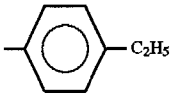 | 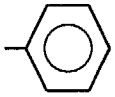 | 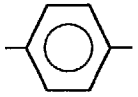 | −H | −H | 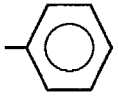 |
| III-12 | 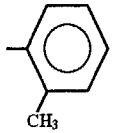 | 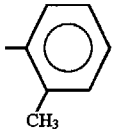 | 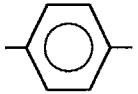 | −H | 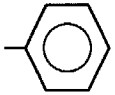 | 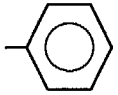 |
| III-13 | 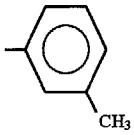 | 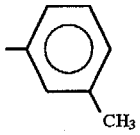 | 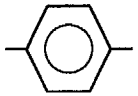 | −H | 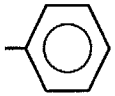 | 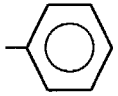 |
| III-14 | 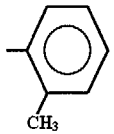 | 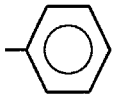 | 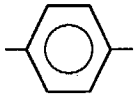 | −H | 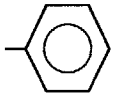 | 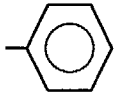 |
| III-15 | 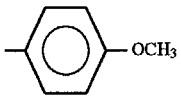 | 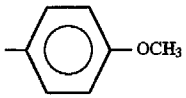 | 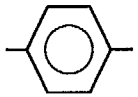 | −H | 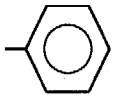 | 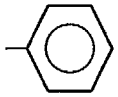 |
| III-16 | 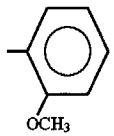 | 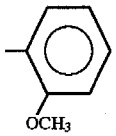 | 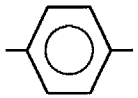 | −H | 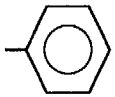 | 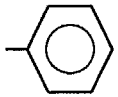 |

TABLE 1-continued
| Compound No. | $Ar^3$ | $Ar^4$ | $Ar^5$ | $R^6$ | $R^7$ | $R^8$ |
|---|---|---|---|---|---|---|
| III-17 | 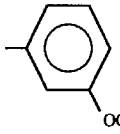 | 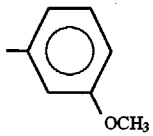 | 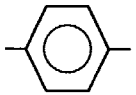 | −H | 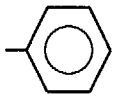 | 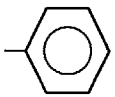 |
| III-18 | 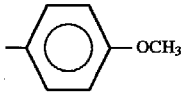 | 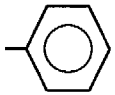 | 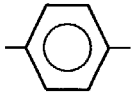 | −H | 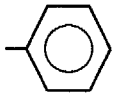 | 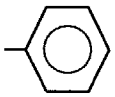 |
| III-19 | 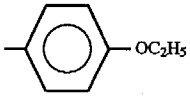 | 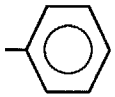 | 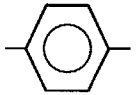 | −H | 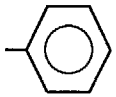 | 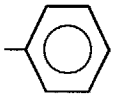 |
| III-20 | 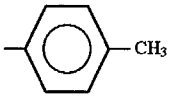 | 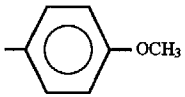 | 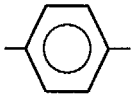 | −H | 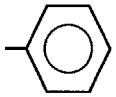 | 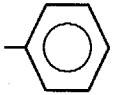 |
| III-21 | 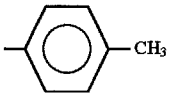 | 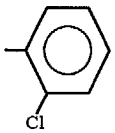 | 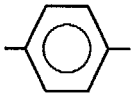 | −H | 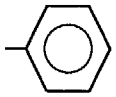 | 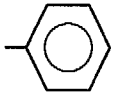 |
| III-22 | 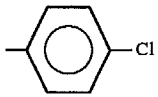 | 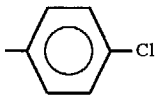 | 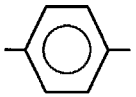 | −H | 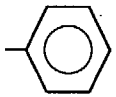 | 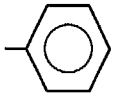 |
| III-23 | 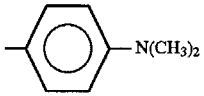 | 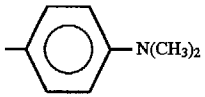 | 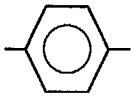 | −H | 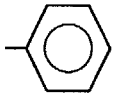 | 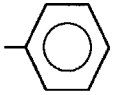 |
| III-24 | 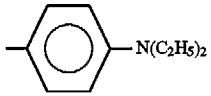 | 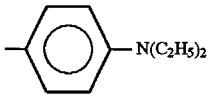 | 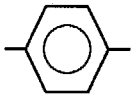 | −H | 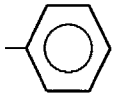 | 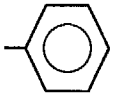 |

TABLE 1-continued
| Compound No. | $Ar^3$ | $Ar^4$ | $Ar^5$ | $R^6$ | $R^7$ | $R^8$ |
|---|---|---|---|---|---|---|
| III-25 | 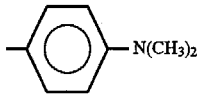 | 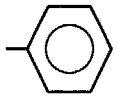 | 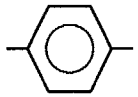 | −H | 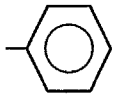 | 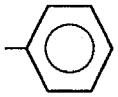 |
| III-26 | 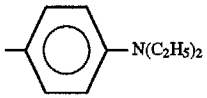 | 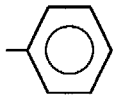 | 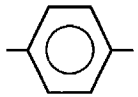 | −H | 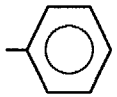 | 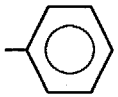 |
| III-27 | 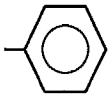 | 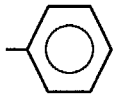 | 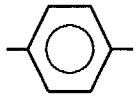 | −H | −H | 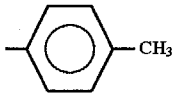 |
| III-28 | 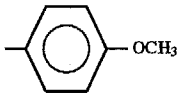 | 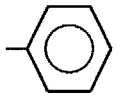 | 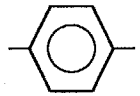 | −H | −H | 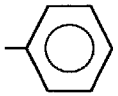 |
| III-29 | 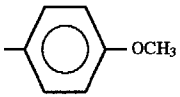 | 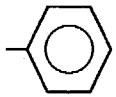 | 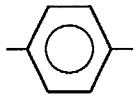 | −H | −H | 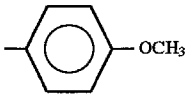 |
| III-30 | 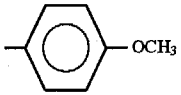 | 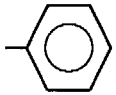 | 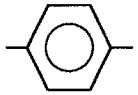 | −H | −H | 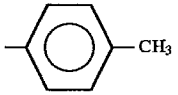 |
| III-31 | 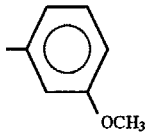 | 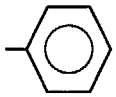 | 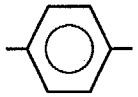 | −H | 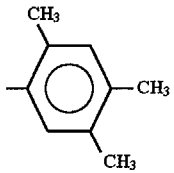 | 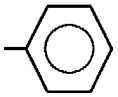 |
| III-32 | 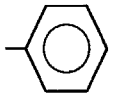 | 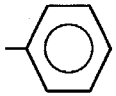 | 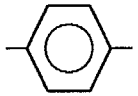 | −H | −H | 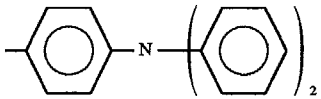 |

TABLE 1-continued
| Compound No. | $Ar^3$ | $Ar^4$ | $Ar^5$ | $R^6$ | $R^7$ | $R^8$ |
|---|---|---|---|---|---|---|
| III-33 | 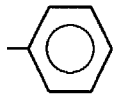 | 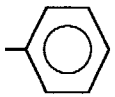 | 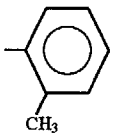 | −H | −H | 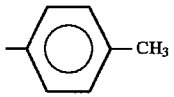 |
| III-34 | 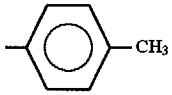 | 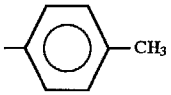 | 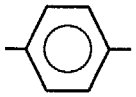 | −H | −H | 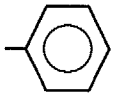 |
| III-35 | 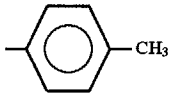 | 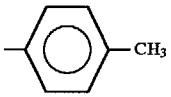 | 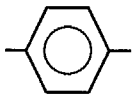 | −H | −H | 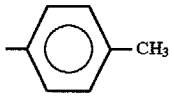 |
| III-36 | 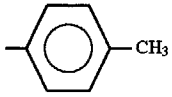 | 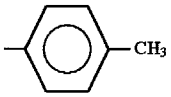 | 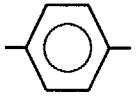 | −H | −H | 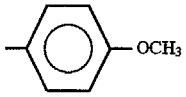 |
| III-37 | 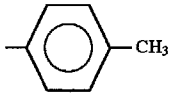 | 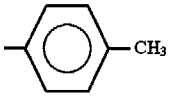 | 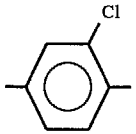 | −H | −H | 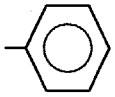 |
| III-38 | 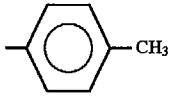 | 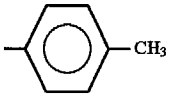 | 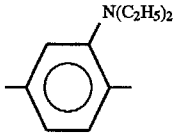 | −H | −H | 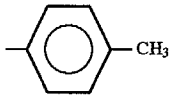 |
| III-39 | 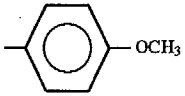 | 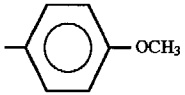 | 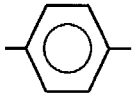 | −H | −H | 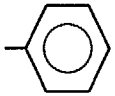 |
| III-40 | 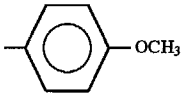 | 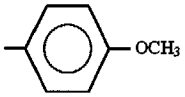 | 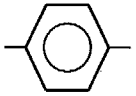 | −H | −H | 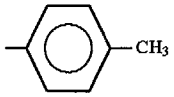 |

TABLE 1-continued
| Compound No. | $Ar^3$ | $Ar^4$ | $Ar^5$ | $R^6$ | $R^7$ | $R^8$ |
|---|---|---|---|---|---|---|
| III-41 | 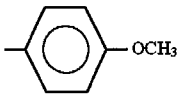 | 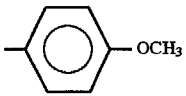 | 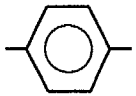 | −H | −H | 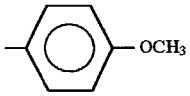 |
| III-42 | 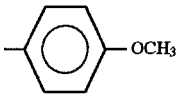 | 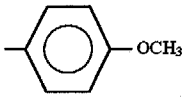 | 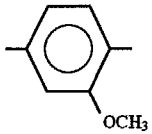 | −H | −H | 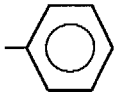 |
| III-43 | 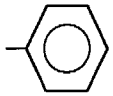 | 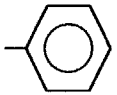 | 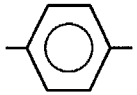 | −H | −H | 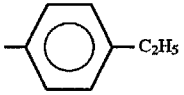 |
| III-44 | 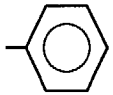 | 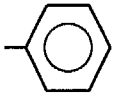 | 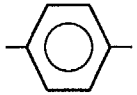 | −H | −H | 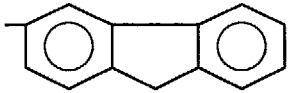 |
| III-45 | 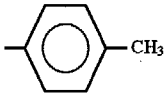 | 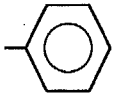 | 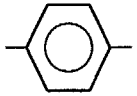 | −H | −H | 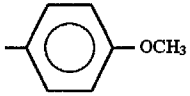 |
| III-46 | 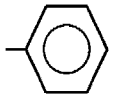 | 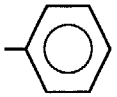 | 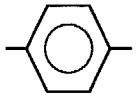 | −H | −H | 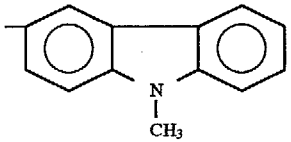 |
| III-47 | 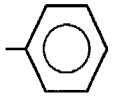 | 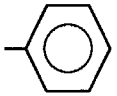 | 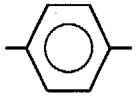 | −H | −H | 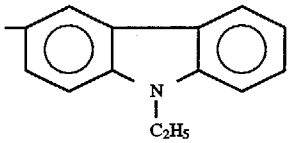 |
| III-48 | 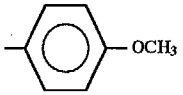 | 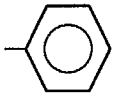 | 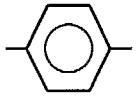 | −H | −H | 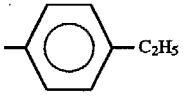 |

TABLE 1-continued
| Compound No. | $Ar^3$ | $Ar^4$ | $Ar^5$ | $R^6$ | $R^7$ | $R^8$ |
|---|---|---|---|---|---|---|
| III-49 | 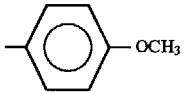 | 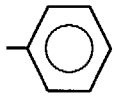 | 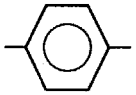 | −H | −H | 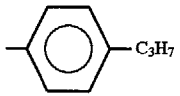 |
| III-50 | 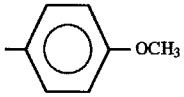 | 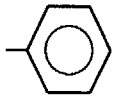 | 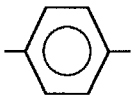 | −H | −H | 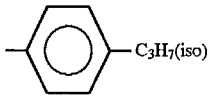 |
| III-51 | 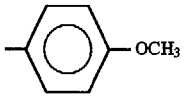 | 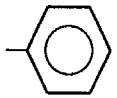 | 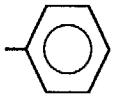 | −H | −H | 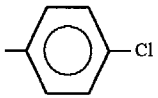 |
| III-52 | 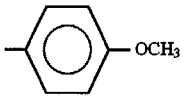 | 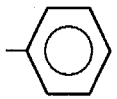 | 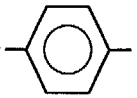 | −H | −H | 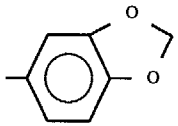 |
| III-53 | 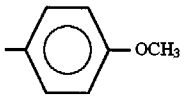 | 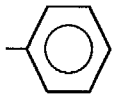 | 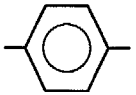 | −H | −H | 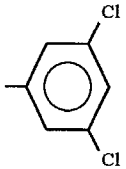 |
| III-54 | 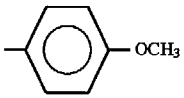 | 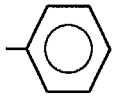 | 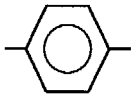 | −H | −H | 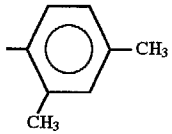 |
| III-55 | 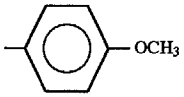 | 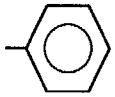 | 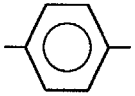 | −H | −H | 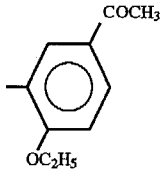 |

TABLE 1-continued
| Compound No. | $Ar^3$ | $Ar^4$ | $Ar^5$ | $R^6$ | $R^7$ | $R^8$ |
|---|---|---|---|---|---|---|
| III-56 | 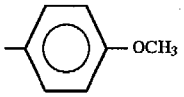 | 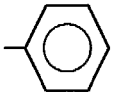 | 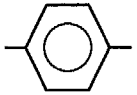 | −H | −H | 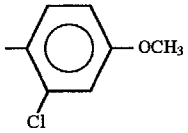 |
| III-57 | 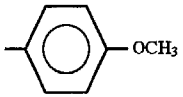 | 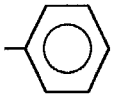 | 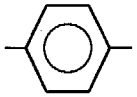 | −H | −H | 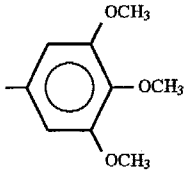 |
| III-58 | 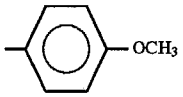 | 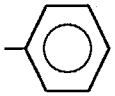 | 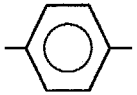 | −H | −H | 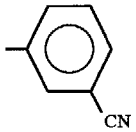 |
| III-59 | 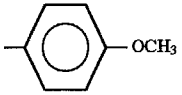 | 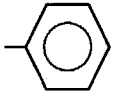 | 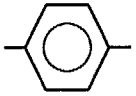 | −H | −H | 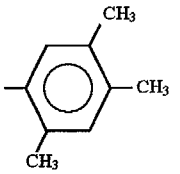 |
| III-60 | 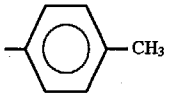 | 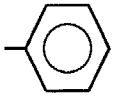 | 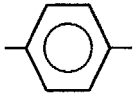 | −H | −H | 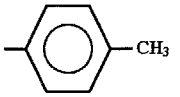 |
| III-61 | 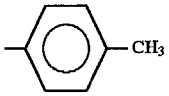 | 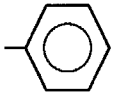 | 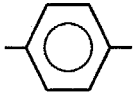 | −H | −H | 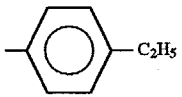 |
| III-62 | 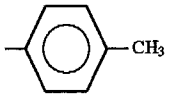 | 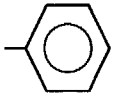 | 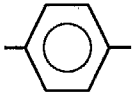 | −H | −H | 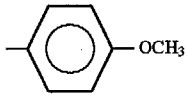 |

TABLE 1-continued
| Compound No. | $Ar^3$ | $Ar^4$ | $Ar^5$ | $R^6$ | $R^7$ | $R^8$ |
|---|---|---|---|---|---|---|
| III-63 | 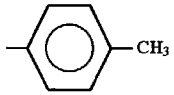 | 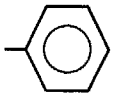 | 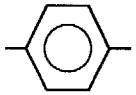 | −H | −H | 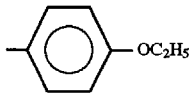 |
| III-64 | 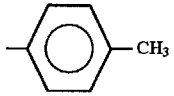 | 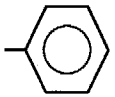 | 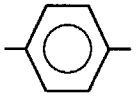 | −H | −H | 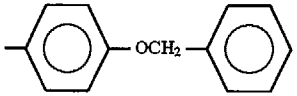 |
| III-65 | 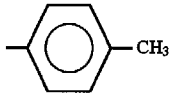 | 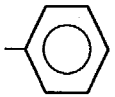 | 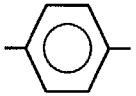 | −H | −H | 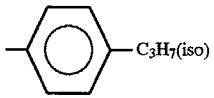 |
| III-66 | 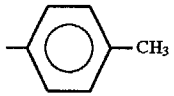 | 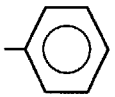 | 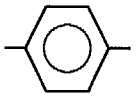 | −H | −H | 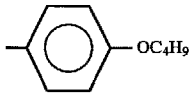 |
| III-67 | 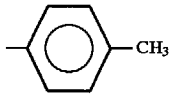 | 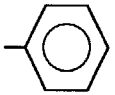 | 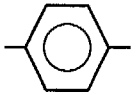 | −H | −H | 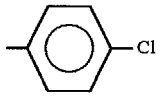 |
| III-68 | 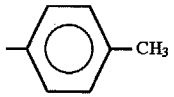 | 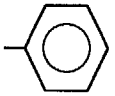 | 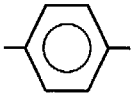 | −H | −H | 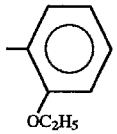 |
| III-69 | 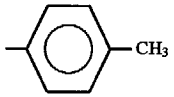 | 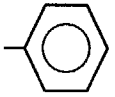 | 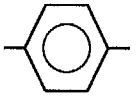 | −H | −H | 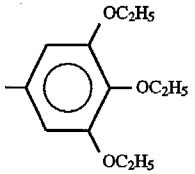 |
| III-70 | 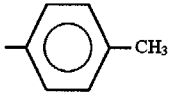 | 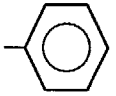 | 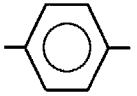 | −H | −H | 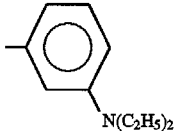 |

TABLE 1-continued
| Compound No. | $Ar^3$ | $Ar^4$ | $Ar^5$ | $R^6$ | $R^7$ | $R^8$ |
|---|---|---|---|---|---|---|
| III-71 | 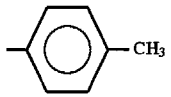 | 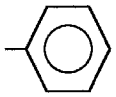 | 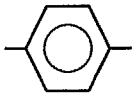 | −H | −H | 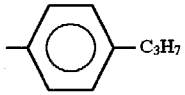 |
| III-72 | 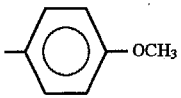 | 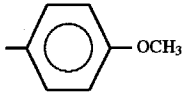 | 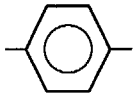 | −H | −H | 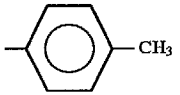 |
| III-73 | 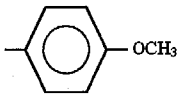 | 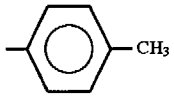 | 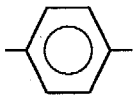 | −H | −H | 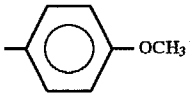 |
| III-74 | 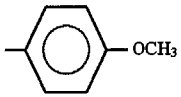 | 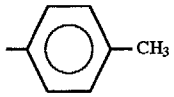 | 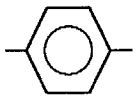 | −H | −H | 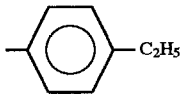 |
| III-75 | 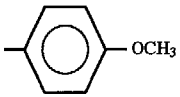 | 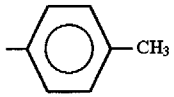 | 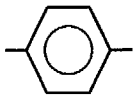 | −H | −H | 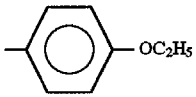 |
| III-76 | 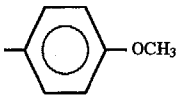 | 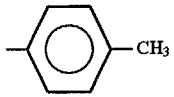 | 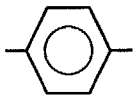 | −H | −H | 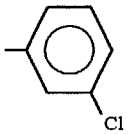 |
| III-77 | 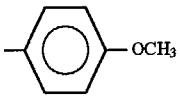 | 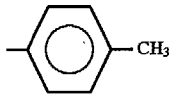 | 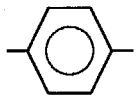 | −H | −H | 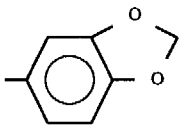 |
| III-78 | 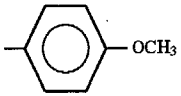 | 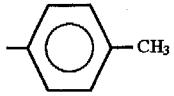 | 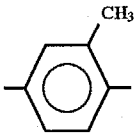 | −H | −H | 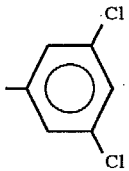 |

TABLE 1-continued
| Compound No. | $Ar^3$ | $Ar^4$ | $Ar^5$ | $R^6$ | $R^7$ | $R^8$ |
|---|---|---|---|---|---|---|
| III-79 | 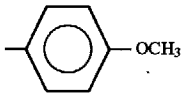 | 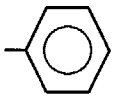 | 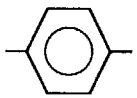 | −H | −H | 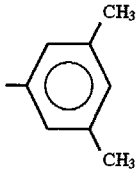 |
| III-80 | 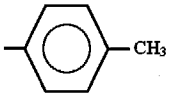 | 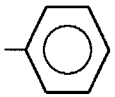 | 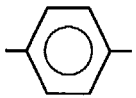 | −H | −H | 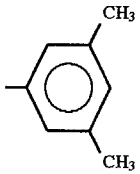 |
| III-81 | 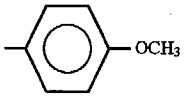 | 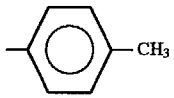 | 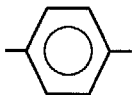 | −H | −H | 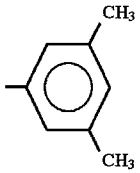 |
| III-82 | 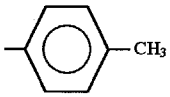 | 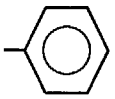 | 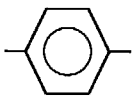 | −H | −H | 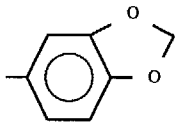 |
| III-83 | 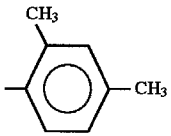 | 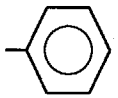 | 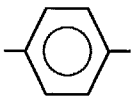 | $-CH_3$ | −H | 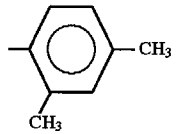 |
| III-84 | 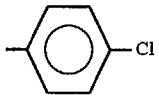 | 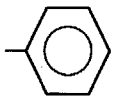 | 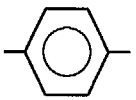 | $-CH_3$ | −H | 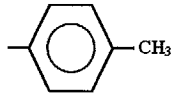 |

TABLE 1-continued
| Compound No. | $Ar^3$ | $Ar^4$ | $Ar^5$ | $R^6$ | $R^7$ | $R^8$ |
|---|---|---|---|---|---|---|
| III-85 | 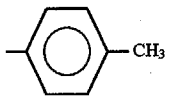 | 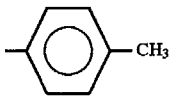 | 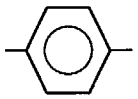 | −H | $-CH_3$ | 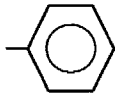 |
| III-86 | 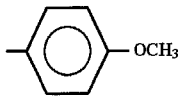 | 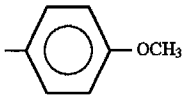 | 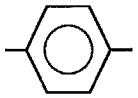 | −H | $-CH_3$ | 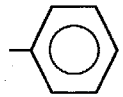 |
| III-87 | 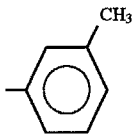 | 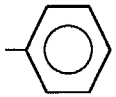 | 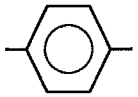 | −H | 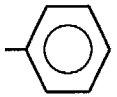 | 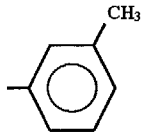 |
| III-88 | 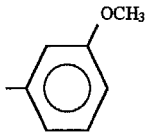 | 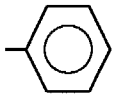 | 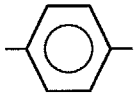 | −H | 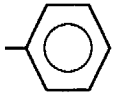 | 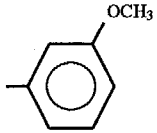 |
| III-89 | 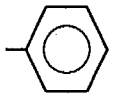 | 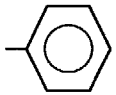 | 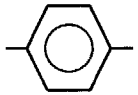 | −H | 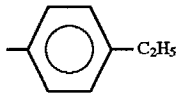 | 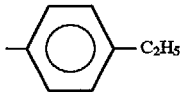 |
| III-90 | 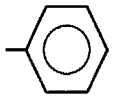 | 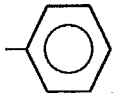 | 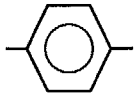 | −H | −H | 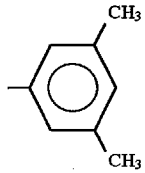 |
| III-91 | 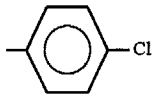 | 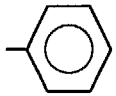 | 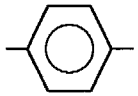 | −H | −H | 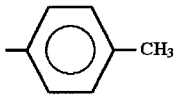 |
| III-92 | 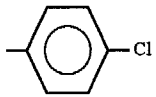 | 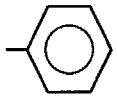 | 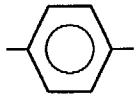 | −H | 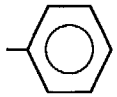 | 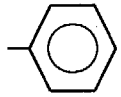 |

TABLE 1-continued
| Compound No. | $Ar^3$ | $Ar^4$ | $Ar^5$ | $R^6$ | $R^7$ | $R^8$ |
|---|---|---|---|---|---|---|
| III-93 | 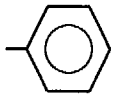 | 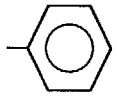 | 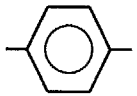 | −H | 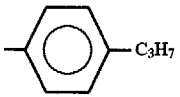 | 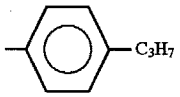 |
| III-94 | 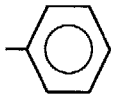 | 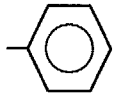 | 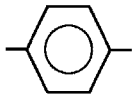 | −H | −H | 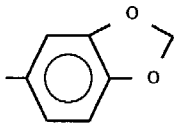 |
| III-95 | 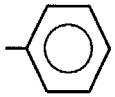 | 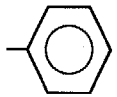 | 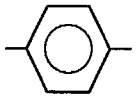 | −H | 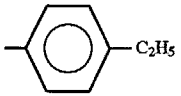 | 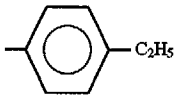 |
| III-96 | 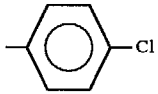 | 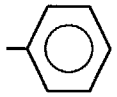 | 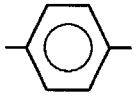 | −H | −H | 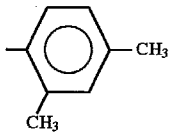 |
| III-97 | 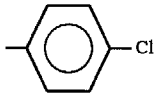 | 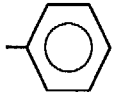 | 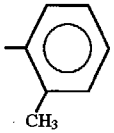 | −H | 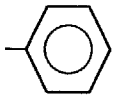 | 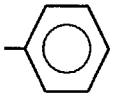 |
| III-98 | 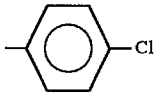 | 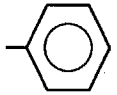 | 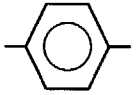 | −H | −H | 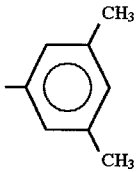 |
| III-99 | 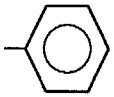 | 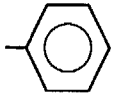 | 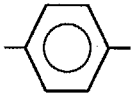 | −H | −H | 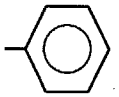 |
| III-100 | 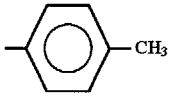 | 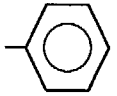 | 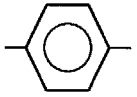 | −H | −H | 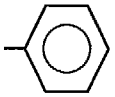 |

TABLE 1-continued
| Compound No. | $Ar^3$ | $Ar^4$ | $Ar^5$ | $R^6$ | $R^7$ | $R^8$ |
|---|---|---|---|---|---|---|
| III-101 | 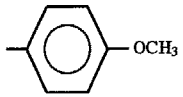 | 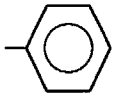 | 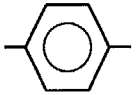 | −H | 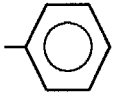 | 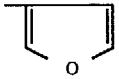 |
| III-102 | 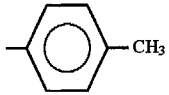 | 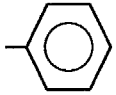 | 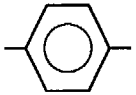 | −H | −H | 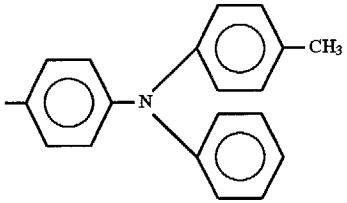 |
| III-103 | 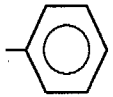 | 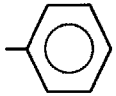 | 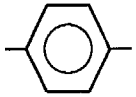 | −H | 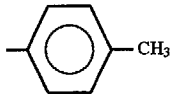 | 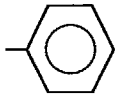 |
| III-104 | 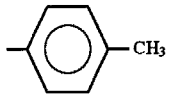 | 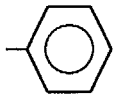 | 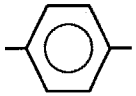 | −H | 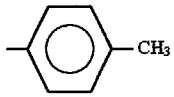 | 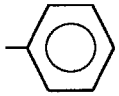 |
| III-105 | 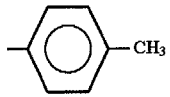 | 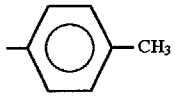 | 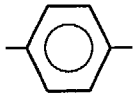 | −H | 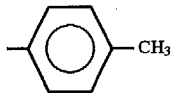 | 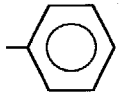 |
| III-106 | 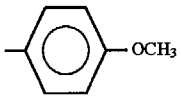 | 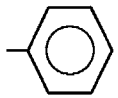 | 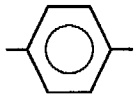 | −H | 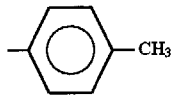 | 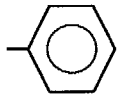 |
| III-107 | 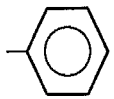 | 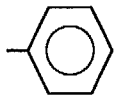 | 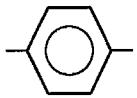 | −H | 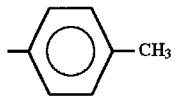 | 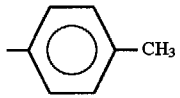 |

TABLE 1-continued
| Compound No. | $Ar^3$ | $Ar^4$ | $Ar^5$ | $R^6$ | $R^7$ | $R^8$ |
|---|---|---|---|---|---|---|
| III-108 | 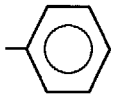 | 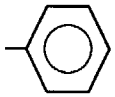 | 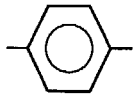 | −H | | 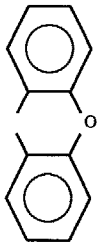 |
| III-109 | 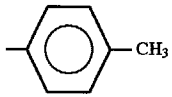 | 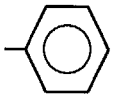 | 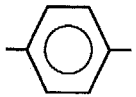 | −H | | 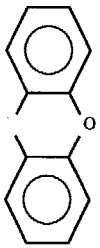 |
| III-110 | 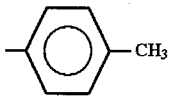 | 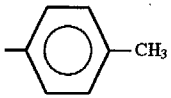 | 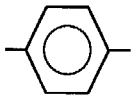 | −H | | 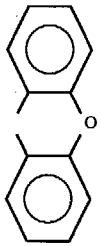 |
| III-111 | 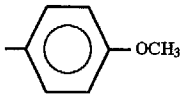 | 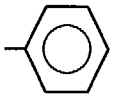 | 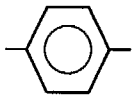 | −H | | 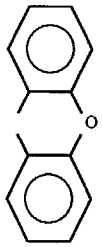 |

TABLE 1-continued
| Compound No. | $Ar^3$ | $Ar^4$ | $Ar^5$ | $R^6$ | $R^7$ | $R^8$ |
|---|---|---|---|---|---|---|
| III-112 | 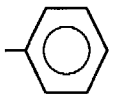 | 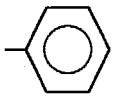 | 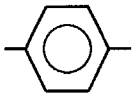 | −H | | 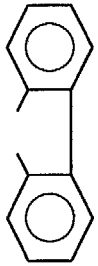 |
| III-113 | 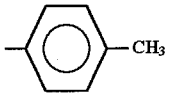 | 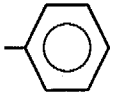 | 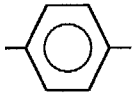 | −H | | 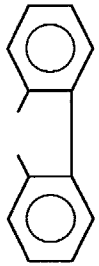 |
| III-114 | 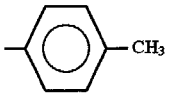 | 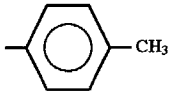 | 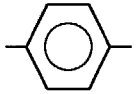 | −H | | 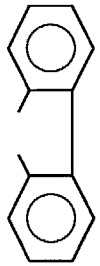 |

TABLE 1-continued
| Compound No. | $Ar^3$ | $Ar^4$ | $Ar^5$ | $R^6$ | $R^7$ | $R^8$ |
|---|---|---|---|---|---|---|
| III-115 | 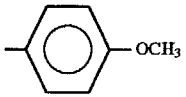 | 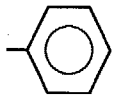 | 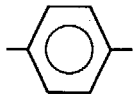 | −H | | 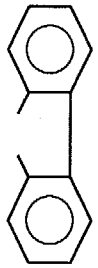 |
| III-116 | 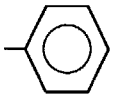 | 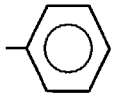 | 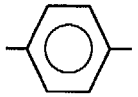 | −H | | 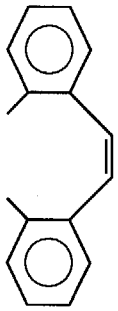 |
| III-117 | 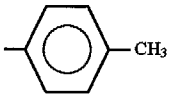 | 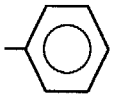 | 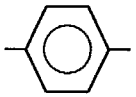 | −H | | 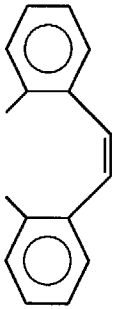 |

TABLE 1-continued
| Compound No. | $Ar^3$ | $Ar^4$ | $Ar^5$ | $R^6$ | $R^7$ | $R^8$ |
|---|---|---|---|---|---|---|
| III-118 | 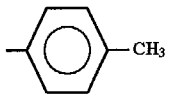 | 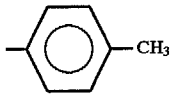 | 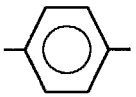 | −H | | 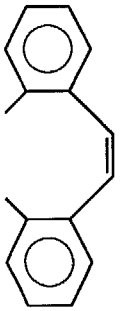 |
| III-119 | 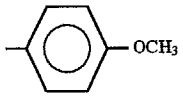 | 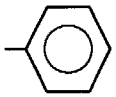 | 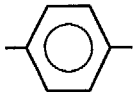 | −H | | 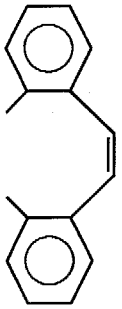 |
| III-120 (*) | 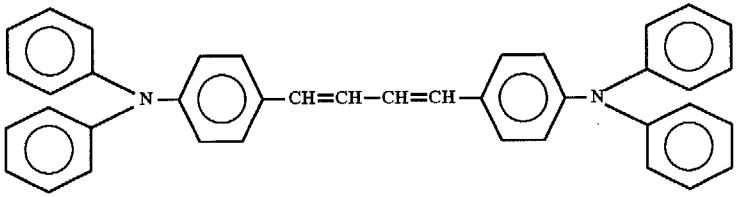 | | | | | |
| III-121 (*) | 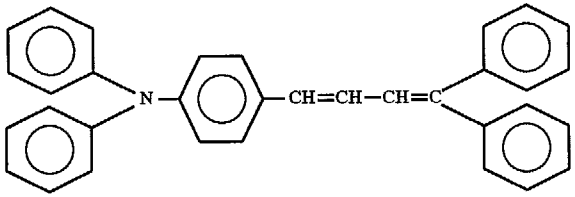 | | | | | |

TABLE 1-continued
| Compound No. | $Ar^3$ | $Ar^4$ | $Ar^5$ | $R^6$ | $R^7$ | $R^8$ |
|---|---|---|---|---|---|---|
| III-122 (*) | | 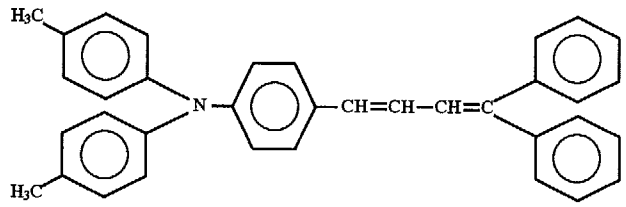 | | | | |
| III-123 (*) | | 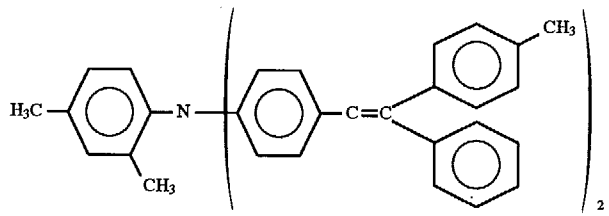 | | | | |
| III-124 (*) | | 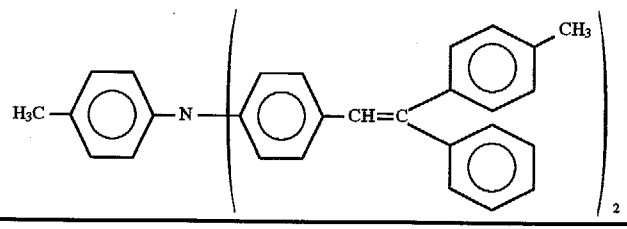 | | | | |
(*)Compounds III-120 to III-124 are specific examples in which n = 1.

Other features of this invention will become apparent in the course of the following description of exemplary embodiments, which are given for illustration of the invention and are not intended to be limiting thereof.

dissolving 4 parts by weight of a polyvinyl butyral (Trademark "BM-2", made by Sekisui Chemical Co., Ltd.) in 150 parts by weight of cyclohexanone, and the mixture was dispersed in a ball mill for 48 hours.

(IV)

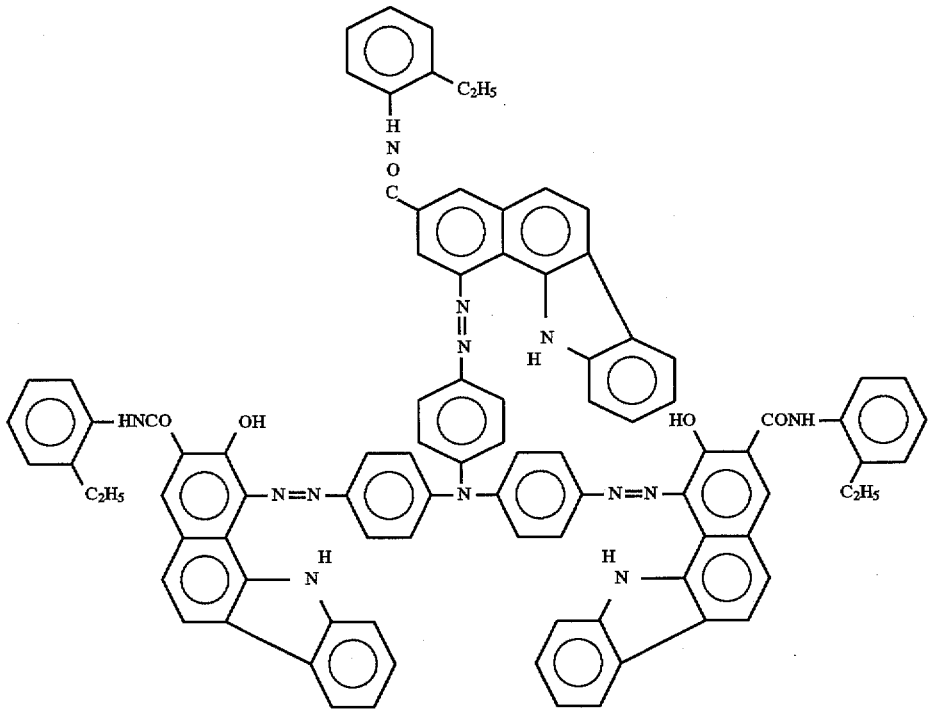

EXAMPLE 1

[Formation of Intermediate Layer]

A mixture of the following components was dispersed in a ball mill for 72 hours to prepare a coating liquid for an intermediate layer:

| | Parts by Weight |
|---|---|
| Titanium oxide (Trademark "TM-1", made by Fuji Titanium Industry Co., Ltd.) | 75 |
| Acrylic resin (Trademark "Acrydic A-460-60", made by Dainippon Ink & Chemicals, Incorporated.) (solid content: 60%) | 15 |
| Melamine resin (Trademark "Super Beckamine G-821-60", made by Dainippon Ink & Chemicals, Incorporated.) (solid content: 60%) | 10 |
| Methyl ethyl ketone | 100 |

The thus obtained intermediate layer coating liquid was coated on an aluminum plate (Trademark "A1080", made by Sumitomo Light Metal Industries, Ltd.) with a thickness of 0.2 mm, and dried at 140° C. for 20 minutes, so that an intermediate layer with a thickness of 3 μm was provided on the electroconductive support.

[Formation of Charge Generation Layer]

10 parts by weight of a trisazo pigment of the following formula (IV) were added to a resin solution prepared by 48 hours later, the mixture was further dispersed for 3 hours with the addition thereto of 210 parts by weight of cyclohexanone, so that a coating liquid for a charge generation layer was obtained. The thus obtained charge generation layer coating liquid was coated on the intermediate layer and dried at 130° C. for 10 minutes, so that a charge generation layer with a thickness of 0.2 μm was provided on the intermediate layer.

[Formation of Charge Transport Layer]

The following components were dissolved in 100 parts by weight of tetrahydrofuran, so that a coating liquid for a charge transport layer was prepared:

| | Parts by Weight |
|---|---|
| Charge transporting material with the following formula (V): | 7 |
| Polycarbonate (Trademark "Panlite K-1300", made by Teijin Chemicals Ltd.) | 10 |
| Silicone oil (Trademark "KF-50", made by Shin-Etsu Chemical Co., Ltd.) | 0.002 |
| o-terphenyl (available from Tokyo Kasei Kogyo Co., Ltd.) | 1 |

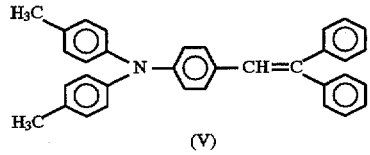

(V)

The thus obtained charge transport layer coating liquid was coated on the charge generation layer and dried at 130°

C. for 20 minutes, so that a charge transport layer with a thickness of 25 μm was provided on the charge generation layer.

Thus, an electrophotographic photoconductor No. 1 according to the present invention was obtained.

EXAMPLE 2

The procedure for preparation of the electrophotographic photoconductor No. 1 according to the present invention in Example 1 was repeated except that o-terphenyl for use in the charge transport layer coating liquid in Example 1 was replaced by compound No. (I)-40, and the charge transporting material of formula (V) for use in the charge transport layer coating liquid in Example 1 was replaced by the following charge transporting material of formula (VIII):

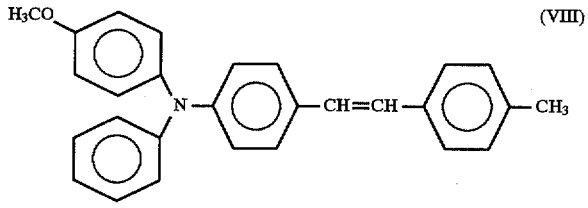

(VIII)

Thus, an electrophotographic photoconductor No. 2 according to the present invention was obtained.

EXAMPLES 3 to 5

The procedure for preparation of the electrophotographic photoconductor No. 2 according to the present invention in Example 2 was repeated except that the compound No. (I)-40 for use in the charge transport layer coating liquid in Example 2 was replaced by compounds Nos. (I)-12, (I)-34 and (I)-52, respectively in Examples 3, 4 and 5, as shown in Table 2.

Thus, electrophotographic photoconductors Nos. 3 to 5 according to the present invention were obtained.

Comparative Example 1

The procedure for preparation of the electrophotographic photoconductor No. 1 according to the present invention in Example 1 was repeated except that o-terphenyl in an amount of 1 part by weight for use in the charge transport layer coating liquid in Example 1 was not employed.

Thus, a comparative electrophotographic photoconductor No. 1 was obtained.

Comparative Examples 2 to 4

The procedure for preparation of the comparative electrophotographic photoconductor No. 1 in Comparative Example 1 was repeated except that the charge transporting material of formula (V) for use in the charge transport layer coating liquid in Comparative Example 1 was replaced by the following charge transporting materials (VI), (VII) and (VIII) respectively in Comparative Examples 2, 3 and 4.

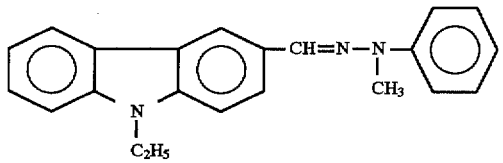

(VI)

-continued

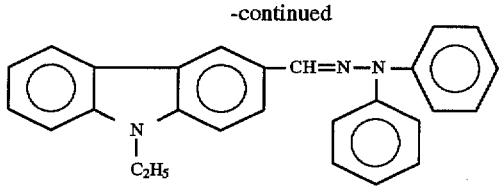

(VII)

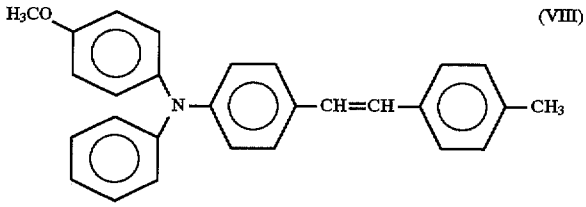

(VIII)

Thus, comparative electrophotographic photoconductors Nos. 2 to 4 were obtained.

Comparative Example 5

The procedure for preparation of the comparative electrophotographic photoconductor No. 1 in Comparative Example 1 was repeated except that 2,6-di-tert-butyl-p-cresol (Trademark "Nocrac 200", made by Ouchi-Shinko Chemical Industrial Co., Ltd.) in an amount of 0.5 parts by weight was added to the formulation for the charge transport layer coating liquid in Comparative Example 1.

Thus, a comparative electrophotographic photoconductor No. 5 was obtained.

Comparative Example 6

The procedure for preparation of the comparative electrophotographic photoconductor No. 1 in Comparative Example 1 was repeated except that zinc stearate (available from Kanto Chemical Co., Inc.) in an amount of 0.5 parts by weight was added to the formulation for the charge transport layer coating liquid in Comparative Example 1.

Thus, a comparative electrophotographic photoconductor No. 6 was obtained.

EXAMPLE 6

The procedure for preparation of the comparative electrophotographic photoconductor No. 1 in Comparative Example 1 was repeated except that the polycarbonate (Trademark "Panlite K-1300", made by Teijin Chemicals Ltd.) for use in the charge transport layer coating liquid in Comparative Example 1 was replaced by a Z type polycarbonate with a viscosity-average molecular weight of 50,000.

Thus, an electrophotographic photoconductor No. 6 according to the present invention was obtained.

EXAMPLE 7

The procedure for preparation of the electrophotographic photoconductor No. 6 according to the present invention in Example 6 was repeated except that compound No. (I)-41 in an amount of 1 part by weight was added to the formulation for the charge transport layer coating liquid in Example 6.

Thus, an electrophotographic photoconductor No. 7 according to the present invention was obtained.

EXAMPLES 8 TO 10

The procedure for preparation of the electrophotographic photoconductor No. 7 according to the present invention in Example 7 was repeated except that the compound No.

(I)-41 for use in the charge transport layer coating liquid in Example 7 was replaced by compounds Nos. (I)-12, (I)-34 and (I)-52, respectively in Examples 8, 9 and 10, as shown in Table 2.

Thus, electrophotographic photoconductors Nos. 8 to 10 according to the present invention were obtained.

Comparative Example 7

The procedure for preparation of the electrophotographic photoconductor No. 6 according to the present invention in Example 6 was repeated except that the charge transporting material of formula (V) for use in the charge transport layer coating liquid in Example 6 was replaced by the following charge transporting material of formula (VI):

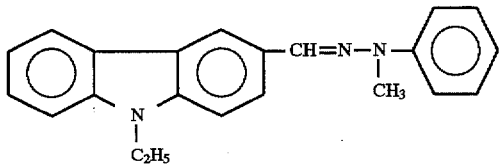

(VI)

Thus, a comparative electrophotographic photoconductor No. 7 was obtained.

The oxygen transmission coefficient of the charge transport layer of each electrophotographic photoconductor, and the charge mobility of the charge transporting material employed in each charge transport layer were measured by the previously mentioned methods. The results are shown in Table 2.

commercially available test apparatus (Trademark "SP-428", made by Kawaguchi Electro Works Co., Ltd.).

To be more specific, each photoconductor was charged negatively in the dark under application of −6 kV by corona charge for 5 seconds. Then, each photoconductor was allowed to stand in the dark without applying any charge thereto for 2 seconds, and the surface potential V2 (−V) was measured. In addition, when the surface potential of the photoconductor reached −800 V, the photoconductor was illuminated by the light of 780 nm with a light intensity of 2.8 $\mu W/cm^2$ separated by use of a band pass filter. In each case, the exposure $E_{1/2}$ ($\mu J/cm^2$) required to reduce the surface potential to ½ the surface potential, that is, −400 V, was measured. Further, the surface potential V30 (−V) was measured after the photoconductor was subjected to light exposure for 30 seconds.

To evaluate the gas resistance of each electrophotographic photoconductor, each photoconductor was allowed to stand under the circumstances of 20° C. and 30%RH, and at a concentration of $NO_x$ ($NO+NO_2$) of 20 ppm for 2 days. Two days later, the dynamic electrostatic properties of each photoconductor were measured in the same manner as previously mentioned.

The results are shown in Table 2.

TABLE 2

| | CTM (*) for use in CTL (**) | Added Compound in CTL | Initial Stage V2 | Initial Stage $E_{1/2}$ | Initial Stage V30 | After Exposed to $NO_x$ V2 | After Exposed to $NO_x$ $E_{1/2}$ | After Exposed to $NO_x$ V30 | Oxygen Transmission Coefficient of CTL ($cm^3 \cdot cm/cm^2 \cdot sec \cdot cmHg$) | Charge Mobility of CTM in CTL ($cm^2/v \cdot s$) |
|---|---|---|---|---|---|---|---|---|---|---|
| Ex. 1 | (V) | o-terphenyl | −854 | 0.46 | −8 | −794 | 0.45 | −18 | $2.86 \times 10^{-11}$ | $3.1 \times 10^{-5}$ |
| Ex. 2 | (VIII) | (I)-40 | −855 | 0.46 | −6 | −793 | 0.45 | −16 | $2.95 \times 10^{-11}$ | $1.8 \times 10^{-5}$ |
| Ex. 3 | (VIII) | (I)-12 | −850 | 0.39 | −4 | −800 | 0.39 | −14 | $2.71 \times 10^{-11}$ | $1.8 \times 10^{-5}$ |
| Ex. 4 | (VIII) | (I)-34 | −860 | 0.40 | −4 | −806 | 0.40 | −14 | $2.73 \times 10^{-11}$ | $1.8 \times 10^{-5}$ |
| Ex. 5 | (VIII) | (I)-52 | −865 | 0.40 | −4 | −812 | 0.40 | −13 | $2.75 \times 10^{-11}$ | $1.8 \times 10^{-5}$ |
| Ex. 6 | (V) | — | −848 | 0.43 | −4 | −795 | 0.42 | −7 | $2.55 \times 10^{-11}$ | $3.1 \times 10^{-5}$ |
| Ex. 7 | (V) | (I)-41 | −856 | 0.43 | −6 | −816 | 0.42 | −9 | $1.76 \times 10^{-11}$ | $3.1 \times 10^{-5}$ |
| Ex. 8 | (V) | (I)-12 | −865 | 0.40 | −5 | −835 | 0.39 | −8 | $1.52 \times 10^{-11}$ | $3.1 \times 10^{-5}$ |
| Ex. 9 | (V) | (I)-34 | −871 | 0.41 | −5 | −840 | 0.40 | −8 | $1.55 \times 10^{-11}$ | $3.1 \times 10^{-5}$ |
| Ex. 10 | (V) | (I)-52 | −875 | 0.41 | −4 | −845 | 0.40 | −7 | $1.56 \times 10^{-11}$ | $3.1 \times 10^{-5}$ |
| Comp. Ex. 1 | (V) | — | −845 | 0.43 | −5 | −725 | 0.39 | −19 | $4.49 \times 10^{-11}$ | $3.1 \times 10^{-5}$ |
| Comp. Ex. 2 | (VI) | — | −806 | 0.41 | −22 | −736 | 0.50 | −45 | $1.29 \times 10^{-11}$ | $1.8 \times 10^{-6}$ |
| Comp. Ex. 3 | (VII) | — | −804 | 0.41 | −23 | −734 | 0.50 | −52 | $1.59 \times 10^{-11}$ | $5.6 \times 10^{-6}$ |
| Comp. Ex. 4 | (VIII) | — | −848 | 0.43 | −8 | −740 | 0.40 | −18 | $4.21 \times 10^{-11}$ | $1.8 \times 10^{-5}$ |
| Comp. Ex. 5 | (V) | 2,6-di-tert-butyl-p-cresol | −861 | 0.46 | −8 | −740 | 0.49 | −18 | $4.35 \times 10^{-11}$ | $3.1 \times 10^{-5}$ |
| Comp. Ex. 6 | (V) | Zinc stearate | −890 | 0.52 | −21 | −772 | 0.60 | −36 | $4.44 \times 10^{-11}$ | $3.1 \times 10^{-5}$ |
| Comp. Ex. 7 | (VI) | — | −816 | 0.43 | −25 | −756 | 0.50 | −45 | $1.10 \times 10^{-11}$ | $1.8 \times 10^{-6}$ |

(*) CTM denotes "charge transporting material".
(**) CTL denotes "charge transport layer".

The dynamic electrostatic properties of each of the electrophotographic photoconductors No. 1 to No. 10 according to the present invention and the comparative electrophotographic photoconductors No. 1 to No. 7 were evaluated under the circumstances of 25° C. and 50%RH by using a

EXAMPLE 11

[Formation of Intermediate Layer]

A mixture of the following components was dispersed in a ball mill for 72 hours to prepare a coating liquid for an intermediate layer:

| | Parts by Weight |
|---|---|
| Titanium oxide (Trademark "TM-1", made by Fuji Titanium Industry Co., Ltd.) | 75 |
| Acrylic resin (Trademark "Acrydic A-460-60" (Trademark), made by Dainippon Ink & Chemicals, Incorporated.) (solid content: 60%) | 15 |
| Melamine resin (Trademark "Super Beckamine G-821-60", made by Dainippon Ink & Chemicals, Incorporated.) (solid content: 60%) | 10 |
| Methyl ethyl ketone | 100 |

The thus obtained intermediate layer coating liquid was coated on an aluminum plate (Trademark "A1080", made by Sumitomo Light Metal Industries, Ltd.) with a thickness of 0.2 mm, and dried at 140° C. for 20 minutes, so that an intermediate layer with a thickness of 3 μm was provided on the electroconductive support.

[Formation of Charge Generation Layer]

100 parts by weight of a trisazo pigment of the following formula (IV) were added to a resin solution prepared by dissolving 4 parts by weight of a polyvinyl butyral (Trademark "BM-2", made by Sekisui Chemical Co., Ltd.) in 150 parts by weight of cyclohexanone, and the mixture was dispersed in a ball mill for 48 hours.

(IV)

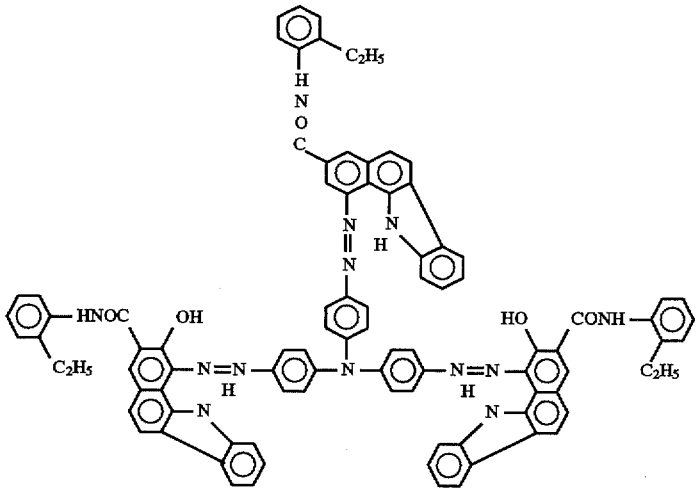

48 hours later, the mixture was further dispersed for 3 hours with the addition thereto of 210 parts by weight of cyclohexanone, so that a coating liquid for a charge generation layer was obtained. The thus obtained charge generation layer coating liquid was coated on the intermediate layer and dried at 130° C. for 10 minutes, so that a charge generation layer with a thickness of 0.2 μm was provided on the intermediate layer.

[Formation of Charge Transport Layer]

The following components were dissolved in 100 parts by weight of tetrahydrofuran, so that a coating liquid for a charge transport layer was prepared:

| | Parts by Weight |
|---|---|
| Charge transporting material with the following formula (V): | 7 |
| Polycarbonate (Trademark "Panlite K-1300", made by Teijin Chemicals Ltd.) | 10 |
| Silicone oil (Trademark "KF-50", made by Shin-Etsu Chemical Co., Ltd.) | 0.002 |

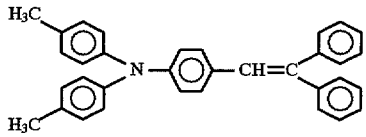

(V)

The thus obtained charge transport layer coating liquid was coated on the charge generation layer and dried at 130° C. for 20 minutes, so that a charge transport layer with a thickness of 25 μm was provided on the charge generation layer.

[Formation of Protective Layer]

20 parts by weight of polycarbonate (Trademark "Panlite C-1400", made by Teijin Chemicals Ltd.), 10 parts by weight of the charge transporting material of formula (V), and 1 part by weight of o-terphenyl (available from Tokyo Kasei Kogyo Co., Ltd.) were dissolved in 500 parts by weight of monochlorobenzene, so that a coating liquid for a protective layer was prepared.

The thus prepared protective layer coating liquid was coated on the charge transport layer by spray coating and dried, whereby a protective layer with a thickness of 4 μm was provided on the charge transport layer.

Thus, an electrophotographic photoconductor No. 11 according to the present invention was obtained.

EXAMPLE 12

The procedure for preparation of the electrophotographic photoconductor No. 11 according to the present invention in Example 11 was repeated except that o-terphenyl for use in the protective layer coating liquid in Example 11 was replaced by compound No. (I)-41, and the charge transporting material of formula (V) for use in the protective layer coating liquid in Example 11 was replaced by the following charge transporting material of formula (VIII):

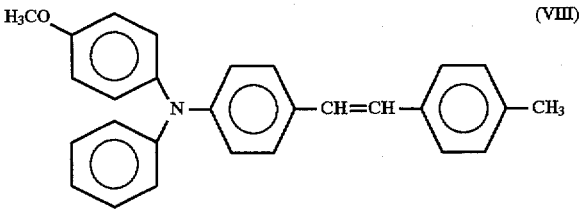

(VIII)

Thus, an electrophotographic photoconductor No. 12 according to the present invention was obtained.

EXAMPLES 13 TO 15

The procedure for preparation of the electrophotographic photoconductor No. 12 according to the present invention in Example 12 was repeated except that the compound No. (I)-41 for use in the protective layer coating liquid in Example 12 was replaced by compounds Nos. (I)-12, (I)-34 and (I)-52, respectively in Examples 13, 14 and 15, as shown in Table 3.

Thus, electrophotographic photoconductors Nos. 13 to 15 according to the present invention were obtained.

Comparative Example 8

The procedure for preparation of the electrophotographic photoconductor No. 11 according to the present invention in Example 11 was repeated except that o-terphenyl in an amount of 1 part by weight for use in the protective layer coating liquid in Example 11 was not employed.

Thus, a comparative electrophotographic photoconductor No. 8 was obtained.

Comparative Examples 9 to 11

The procedure for preparation of the comparative electrophotographic photoconductor No. 8 in Comparative Example 8 was repeated except that the charge transporting material of formula (V) for use in the protective layer coating liquid in Comparative Example 8 was replaced by the following charge transporting materials (VI), (VII) and (VIII), respectively in Comparative Examples 9, 10 and 11.

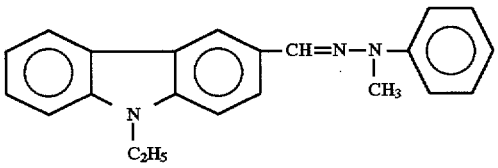

(VI)

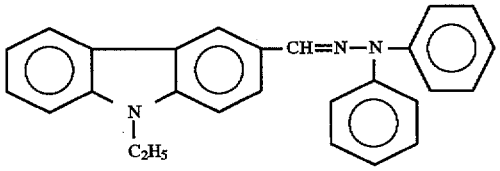

(VII)

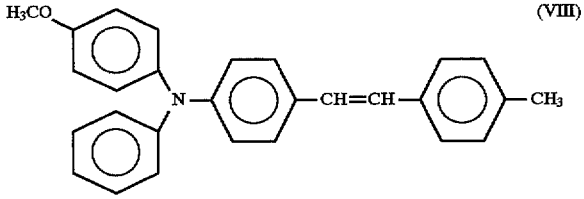

(VIII)

Thus, comparative electrophotographic photoconductors Nos. 9 to 11 were obtained.

Comparative Example 12

The procedure for preparation of the comparative electrophotographic photoconductor No. 8 in Comparative Example 8 was repeated except that 2,6-di-tert-butyl-p-cresol (Trademark "Nocrac 200", made by Ouchi-Shinko Chemical Industrial Co., Ltd.) in an amount of 0.5 parts by weight was added to the formulation for the protective layer coating liquid in Comparative Example 8.

Thus, a comparative electrophotographic photoconductor No. 12 was obtained.

Comparative Example 13

The procedure for preparation of the comparative electrophotographic photoconductor No. 8 in Comparative Example 8 was repeated except that zinc stearate (available from Kanto Chemical Co., Inc.) in an amount of 0.5 parts by weight was added to the formulation for the protective layer coating liquid in Comparative Example 8.

Thus, a comparative electrophotographic photoconductor No. 13 was obtained.

EXAMPLE 16

The procedure for preparation of the comparative electrophotographic photoconductor No. 8 in Comparative Example 8 was repeated except that the polycarbonate (Trademark "Panlite C-1400", made by Teijin Chemicals Ltd.) for use in the protective layer coating liquid in Comparative Example 8 was replaced by a Z type polycarbonate with a viscosity-average molecular weight of 50,000.

Thus, an electrophotographic photoconductors No. 16 according to the present invention was obtained.

EXAMPLE 17

The procedure for preparation of the electrophotographic photoconductor No. 16 according to the present invention in Example 16 was repeated except that compound No. (I)-40 in an amount of 1 part by weight was added to the formulation for the protective layer coating liquid in Example 16.

Thus, an electrophotographic photoconductor No. 17 according to the present invention was obtained.

EXAMPLES 18 TO 20

The procedure for preparation of the electrophotographic photoconductor No. 17 according to the present invention in Example 17 was repeated except that the compound No. (I)-40 for use in the protective layer coating liquid in Example 17 was replaced by compounds Nos. (I)-12, (I)-34 and (I)-52, respectively in Examples 18, 19 and 20, as shown in Table 3.

Thus, electrophotographic photoconductors Nos. 18 to 20 according to the present invention were obtained.

Comparative Example 14

The procedure for preparation of the electrophotographic photoconductor No. 16 according to the present invention in Example 16 was repeated except that the charge transporting material of formula (V) for use in the protective layer coating liquid in Example 16 was replaced by the following charge transporting material of formula (VI):

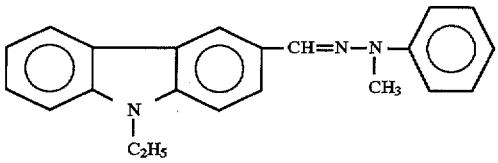

(VI)

Thus, a comparative electrophotographic photoconductor No. 14 was obtained.

The oxygen transmission coefficient of the protective layer of each electrophotographic photoconductor, and the charge mobility of the charge transporting material employed in each protective layer were measured by the previously mentioned methods. The results are shown in Table 3.

The dynamic electrostatic properties of each of the electrophotographic photoconductors No. 11 to No. 20 according to the present invention and the comparative electrophotographic photoconductors No. 8 to No. 14 were evaluated at the initial stage and after exposure to $NO_x$ by the same method as in Example 1.

The results are shown in Table 3.

| | Parts by Weight |
|---|---|
| Titanium oxide (Trademark "CR-EL", made by Ishihara Sangyo Kaisha, Ltd.) | 160 |
| Alkyd resin (Trademark "Beckolite M6401-50-S", made by Dainippon Ink & Chemicals, Incorporated.) (solid content: 50%) | 36 |
| Melamine resin (Trademark "Super Beckamine L-121-60", made by Dainippon Ink & Chemicals, Incorporated.) (solid content: 60%) | 20 |
| Methyl ethyl ketone | 100 |

With the addition of 80 parts by weight of methyl ethyl ketone to the above prepared mixture, dispersion was further continued for 2 hours, so that a coating liquid for an intermediate layer was prepared. The thus obtained intermediate layer coating liquid was coated on the surface of an aluminum cylinder with a length of 370.5 mm and a diameter of 80 mm, and dried at 130° C. for 20 minutes, so that an intermediate layer with a thickness of 2.5 μm was provided on the electroconductive support.

TABLE 3

| | CTM (*) for use in Protective Layer | Added Compound in Protective Layer | Initial Stage V2 | Initial Stage $E_{1/2}$ | Initial Stage V30 | After Exposed to $NO_x$ V2 | After Exposed to $NO_x$ $E_{1/2}$ | After Exposed to $NO_x$ V30 | Oxygen Transmission Coefficient of Protective Layer ($cm^3 \cdot cm/cm^2 \cdot sec \cdot cmHg$) | Charge Mobility of CTM in Protective Layer ($cm^2/V \cdot s$) |
|---|---|---|---|---|---|---|---|---|---|---|
| Ex. 11 | (V) | o-terphenyl | −870 | 0.46 | −9 | −813 | 0.44 | −23 | $3.56 \times 10^{-11}$ | $3.1 \times 10^{-5}$ |
| Ex. 12 | (VIII) | (I)-41 | −868 | 0.46 | −6 | −808 | 0.44 | −20 | $3.61 \times 10^{-11}$ | $1.8 \times 10^{-5}$ |
| Ex. 13 | (VIII) | (I)-12 | −875 | 0.43 | −5 | −825 | 0.42 | −16 | $3.31 \times 10^{-11}$ | $1.8 \times 10^{-5}$ |
| Ex. 14 | (VIII) | (I)-34 | −875 | 0.43 | −6 | −824 | 0.42 | −18 | $3.33 \times 10^{-11}$ | $1.8 \times 10^{-5}$ |
| Ex. 15 | (VIII) | (I)-52 | −873 | 0.43 | −6 | −833 | 0.42 | −18 | $3.35 \times 10^{-11}$ | $1.8 \times 10^{-5}$ |
| Ex. 16 | (V) | — | −865 | 0.45 | −6 | −825 | 0.44 | −18 | $2.98 \times 10^{-11}$ | $3.1 \times 10^{-5}$ |
| Ex. 17 | (V) | (I)-40 | −875 | 0.44 | −6 | −842 | 0.43 | −19 | $2.12 \times 10^{-11}$ | $3.1 \times 10^{-5}$ |
| Ex. 18 | (V) | (I)-12 | −885 | 0.43 | −5 | −855 | 0.42 | −16 | $1.95 \times 10^{-11}$ | $3.1 \times 10^{-5}$ |
| Ex. 19 | (V) | (I)-34 | −881 | 0.43 | −5 | −850 | 0.42 | −16 | $1.98 \times 10^{-11}$ | $3.1 \times 10^{-5}$ |
| Ex. 20 | (V) | (I)-52 | −880 | 0.43 | −6 | −848 | 0.42 | −18 | $1.99 \times 10^{-11}$ | $3.1 \times 10^{-5}$ |
| Comp. Ex. 8 | (V) | — | −865 | 0.45 | −6 | −755 | 0.40 | −20 | $5.08 \times 10^{-11}$ | $3.1 \times 10^{-5}$ |
| Comp. Ex. 9 | (VI) | — | −835 | 0.42 | −15 | −775 | 0.50 | −35 | $1.66 \times 10^{-11}$ | $1.8 \times 10^{-6}$ |
| Comp. Ex. 10 | (VII) | — | −832 | 0.42 | −16 | −774 | 0.52 | −41 | $1.98 \times 10^{-11}$ | $5.6 \times 10^{-6}$ |
| Comp. Ex. 11 | (VIII) | — | −865 | 0.43 | −5 | −785 | 0.43 | −19 | $4.88 \times 10^{-11}$ | $1.8 \times 10^{-5}$ |
| Comp. Ex. 12 | (V) | 2,6-di-tert-butyl-p-cresol | −875 | 0.48 | −6 | −766 | 0.50 | −20 | $4.90 \times 10^{-11}$ | $3.1 \times 10^{-5}$ |
| Comp. Ex. 13 | (V) | Zinc stearate | −880 | 0.50 | −16 | −781 | 0.55 | −36 | $4.95 \times 10^{-11}$ | $3.1 \times 10^{-5}$ |
| Comp. Ex. 14 | (VI) | — | −845 | 0.45 | −16 | −788 | 0.50 | −31 | $1.46 \times 10^{-11}$ | $1.8 \times 10^{-6}$ |

(*) CTM denotes "charge transporting material".

As can be seen from the results shown in Tables 2 and 3, the charging characteristics of the electrophotographic photoconductors according to the present invention are excellent even after exposure to $NO_x$. The gas resistance of the photoconductors according to the present invention is improved.

EXAMPLE 21

[Formation of Intermediate Layer]

A mixture of the following components was dispersed in a ball mill for 72 hours:

[Formation of Charge Generation Layer]

10 parts by weight of a trisazo pigment of the following formula (IV) were added to a resin solution prepared by dissolving 4 parts by weight of a polyvinyl butyral (Trademark "BM-2", made by Sekisui Chemical Co., Ltd.) in 150 parts by weight of cyclohexanone, and the mixture was dispersed in a ball mill for 48 hours.

(IV)

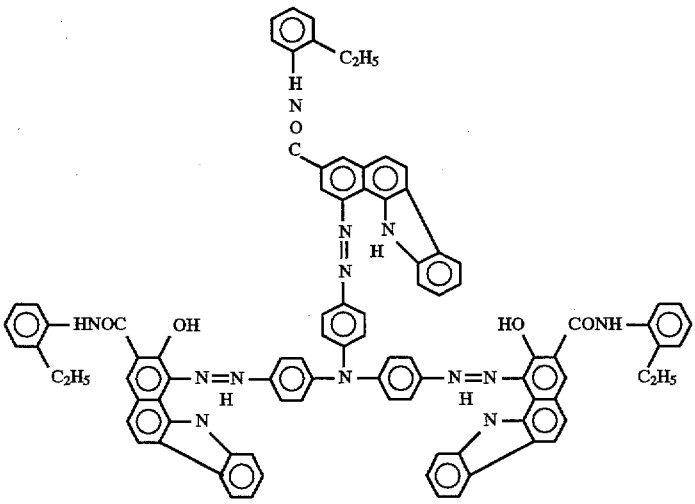

48 hours later, the mixture was further dispersed for 3 hours with the addition thereto of 210 parts by weight of cyclohexanone, so that a coating liquid for a charge generation layer was obtained. The thus obtained charge generation layer coating liquid was coated on the intermediate layer and dried at 130° C. for 10 minutes, so that a charge generation layer with a thickness of 0.2 μm was provided on the intermediate layer.

[Formation of Charge Transport Layer]

The following components were dissolved in 90 parts by weight of dichloromethane, so that a coating liquid for a charge transport layer was prepared:

| | Parts by Weight |
|---|---|
| Charge transporting material with the following formula (V): | 7 |
| 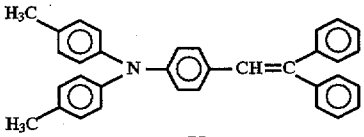 (V) | |
| Polycarbonate (Trademark "Panlite C-1400", made by Teijin Chemicals Ltd.) | 10 |
| Phenothiazine | 0.07 |
| Silicone oil (Trademark "KF-50", made by Shin-Etsu Chemical Co., Ltd.) | 0.002 |
| o-terphenyl | 1 |

The thus obtained charge transport layer coating liquid was coated on the charge generation layer and dried at 120° C. for 20 minutes, so that a charge transport layer with a thickness of 25 μm was provided on the charge generation layer.

Thus, an electrophotographic photoconductor No. 21 according to the present invention was obtained.

EXAMPLE 22

The procedure for preparation of the electrophotographic photoconductor No. 21 according to the present invention in Example 21 was repeated except that o-terphenyl for use in the charge transport layer coating liquid in Example 21 was replaced by compound No. (I)-40, and the charge transporting material of formula (V) for use in the charge transport layer coating liquid in Example 21 was replaced by the following charge transporting material of formula (VIII):

(VIII)

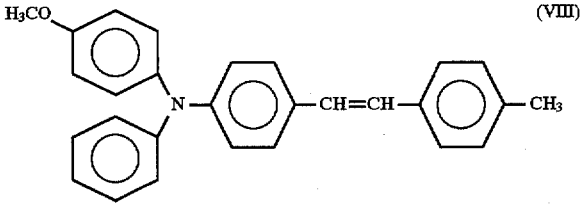

Thus, an electrophotographic photoconductor No. 22 according to the present invention was obtained.

EXAMPLES 23 TO 25

The procedure for preparation of the electrophotographic photoconductor No. 22 according to the present invention in Example 22 was repeated except that the compound No. (I)-40 for use in the charge transport layer coating liquid in Example 22 was replaced by compounds Nos. (I)-12, (I)-34 and (I)-52, respectively in Examples 23, 24 and 25 as shown in Table 4.

Thus, electrophotographic photoconductors Nos. 23 to 25 according to the present invention were obtained.

Comparative Example 15

The procedure for preparation of the electrophotographic photoconductor No. 21 according to the present invention in Example 21 was repeated except that o-terphenyl in an amount of 1 part by weight for use in the charge transport layer coating liquid in Example 21 was not employed.

Thus, a comparative electrophotographic photoconductor No. 15 was obtained.

Comparative Examples 16 to 19

The procedure for preparation of the comparative electrophotographic photoconductor No. 15 in Comparative Example 15 was repeated except that the charge transporting material of formula (V) for use in the charge transport layer coating liquid in Comparative Example 15 was replaced by the following charge transporting materials (VI), (VII), (VIII) and (IX) respectively in Comparative Examples 16, 17, 18 and 19.

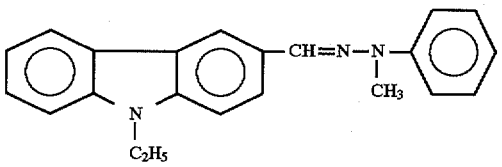

(VI)

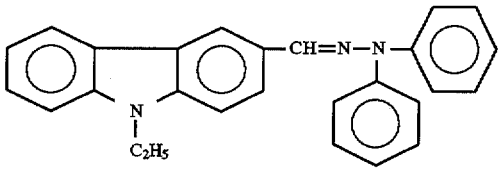

(VII)

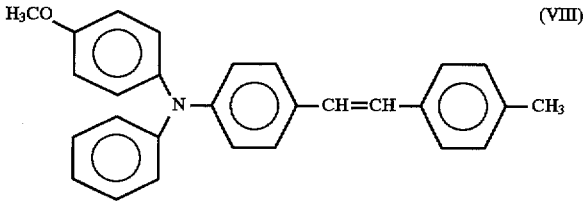

(VIII)

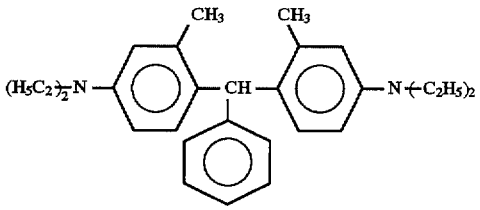

(IX)

Thus, comparative electrophotographic photoconductors Nos. 16 to 19 were obtained.

Comparative Example 20

The procedure for preparation of the comparative electrophotographic photoconductor No. 15 in Comparative Example 15 was repeated except that 2,6-di-tert-butyl-p-cresol (Trademark "Nocrac 200", made by Ouchi-Shinko Chemical Industrial Co., Ltd.) in an amount of 0.5 parts by weight was added to the formulation for the charge transport layer coating liquid in Comparative Example 15.

Thus, a comparative electrophotographic photoconductor No. 20 was obtained.

Comparative Example 21

The procedure for preparation of the comparative electrophotographic photoconductor No. 15 in Comparative Example 15 was repeated except that commercially available bis(2,2,6,6-tetramethyl-4-piperidyl)sebacate (Trademark "Sanol LS-770", made by Sankyo Company, Ltd.) in an amount of 0.5 parts by weight was added to the formulation for the charge transport layer coating liquid in Comparative Example 15.

Thus, a comparative electrophotographic photoconductor No. 21 was obtained.

Comparative Example 22

The procedure for preparation of the comparative electrophotographic photoconductor No. 15 in Comparative Example 15 was repeated except that zinc stearate (available from Kanto Chemical Co., Inc.) in an amount of 0.5 parts by weight was added to the formulation for the charge transport layer coating liquid in Comparative Example 15.

Thus, a comparative electrophotographic photoconductor No. 22 was obtained.

EXAMPLE 26

The procedure for preparation of the comparative electrophotographic photoconductor No. 15 in Comparative Example 15 was repeated except that the polycarbonate (Trademark "Panlite C-1400", made by Teijin Chemicals Ltd.) for use in the charge transport layer coating liquid in Comparative Example 15 was replaced by a Z type polycarbonate with a viscosity-average molecular weight of 50,000.

Thus, an electrophotographic photoconductors No. 26 according to the present invention was obtained.

EXAMPLE 27

The procedure for preparation of the electrophotographic photoconductor No. 26 according to the present invention in Example 26 was repeated except that the compound No. (I)-41 in an amount of 1 part by weight was added to the formulation for the charge transport layer coating liquid in Example 26.

Thus, an electrophotographic photoconductor No. 27 according to the present invention was obtained.

EXAMPLES 28 TO 30

The procedure for preparation of the electrophotographic photoconductor No. 27 according to the present invention in Example 27 was repeated except that the compound No. (I)-41 for use in the charge transport layer coating liquid in Example 27 was replaced by compounds Nos. (I)-12, (I)-34 and (I)-52, respectively in Examples 28, 29 and 30, as shown in Table 4.

Thus, electrophotographic photoconductors Nos. 28 to 30 according to the present invention were obtained.

Comparative Example 23

The procedure for preparation of the electrophotographic photoconductor No. 26 according to the present invention in Example 26 was repeated except that the charge transporting material of formula (V) for use in the charge transport layer coating liquid in Example 26 was replaced by the following charge transporting material of formula (VI):

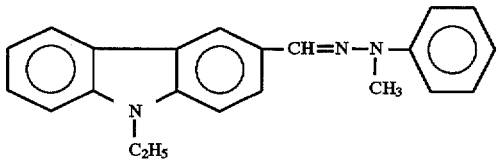

(VI)

Thus, a comparative electrophotographic photoconductor No. 23 was obtained.

The oxygen transmission coefficient of the charge transport layer of each electrophotographic photoconductor, and the charge mobility of the charge transporting material employed in each charge transport layer were measured by the previously mentioned methods. The results are shown in Table 4.

To evaluate the electrostatic properties of each photoconductor and quality of images produced by each photoconductor, each of the electrophotographic photoconductors Nos. 21 to 30 and comparative electrophotographic photoconductors Nos. 15 to 23 was placed in a commercially available copying machine (Trademark "IMAGIO MF530", made by Ricoh Company, Ltd.).

The charging and exposure conditions for forming latent electrostatic images on the photoconductor were controlled so that the potential of a dark portion (VD) of the photoconductor was −850 V and the potential of a light-exposed portion (VL) of the photoconductor was −100 V. After 10,000 copies were continuously made, the copying operation was stopped and the photoconductor was allowed to stand for 24 hours. Then, image formation was carried out again, and the image quality was observed.

Subsequently, 100,000 copies were continuously made in total. During the continuous copying operation, the potentials of the dark portion (VD) and the light-exposed portion (VL) were measured after making 50,000 copies and 100,000 copies in such a manner that a development unit was removed from the copying machine and a probe of a static charge gauge was set into a development position of the photoconductor.

The above-mentioned evaluation was made at 23±3° C. and 50±5%RH under the conditions that the exhaust fan of the copying machine was stopped.

The results are shown in Table 5.

TABLE 4

| | CTM for use in CTL | Added Compound in CTL | Oxygen Transmission Coefficient of CTL ($cm^3 \cdot cm/cm^2 \cdot sec \cdot cmHg$) | Charge Mobility of CTM in CTL ($cm^2/V \cdot s$) |
|---|---|---|---|---|
| Ex. 21 | (V) | o-terphenyl | $2.81 \times 10^{-11}$ | $3.1 \times 10^{-5}$ |
| Ex. 22 | (VIII) | (I)-40 | $2.90 \times 10^{-11}$ | $1.8 \times 10^{-5}$ |
| Ex. 23 | (VIII) | (I)-12 | $2.66 \times 10^{-11}$ | $1.8 \times 10^{-5}$ |
| Ex. 24 | (VIII) | (I)-34 | $2.68 \times 10^{-11}$ | $1.8 \times 10^{-5}$ |
| Ex. 25 | (VIII) | (I)-52 | $2.71 \times 10^{-11}$ | $3.1 \times 10^{-5}$ |
| Ex. 26 | (V) | — | $2.50 \times 10^{-11}$ | $3.1 \times 10^{-5}$ |

TABLE 4-continued

| | CTM for use in CTL | Added Compound in CTL | Oxygen Transmission Coefficient of CTL ($cm^3 \cdot cm/cm^2 \cdot sec \cdot cmHg$) | Charge Mobility of CTM in CTL ($cm^2/V \cdot s$) |
|---|---|---|---|---|
| Ex. 27 | (V) | (I)-41 | $1.72 \times 10^{-11}$ | $3.1 \times 10^{-5}$ |
| Ex. 28 | (V) | (I)-12 | $1.49 \times 10^{-11}$ | $3.1 \times 10^{-5}$ |
| Ex. 29 | (V) | (I)-34 | $1.51 \times 10^{-11}$ | $3.1 \times 10^{-5}$ |
| Ex. 30 | (V) | (I)-52 | $1.51 \times 10^{-11}$ | $3.1 \times 10^{-5}$ |
| Comp. Ex. 15 | (V) | — | $4.42 \times 10^{-11}$ | $3.1 \times 10^{-5}$ |
| Comp. Ex. 16 | (VI) | — | $1.26 \times 10^{-11}$ | $1.8 \times 10^{-6}$ |
| Comp. Ex. 17 | (VII) | — | $1.56 \times 10^{-11}$ | $5.6 \times 10^{-6}$ |
| Comp. Ex. 18 | (VIII) | — | $4.16 \times 10^{-11}$ | $1.8 \times 10^{-5}$ |
| Comp. Ex. 19 | (IX) | — | $1.52 \times 10^{-11}$ | $2.7 \times 10^{-6}$ |
| Comp. Ex. 20 | (V) | 2,6-di-tert-butyl-p-cresol | $4.30 \times 10^{-11}$ | $3.1 \times 10^{-5}$ |
| Comp. Ex. 21 | (V) | Bis(2,2,6,6-tetramethyl-4-piperidyl)-sebacate | $4.31 \times 10^{-11}$ | $3.1 \times 10^{-5}$ |
| Comp. Ex. 22 | (V) | Zinc stearate | $4.38 \times 10^{-11}$ | $3.1 \times 10^{-5}$ |
| Comp. Ex. 23 | (VI) | — | $1.06 \times 10^{-11}$ | $1.8 \times 10^{-6}$ |

TABLE 5

| | Image Evaluation after Intermission of 24 Hours | After Making of 50,000 Copies | | | After Making of 100,000 Copies | | |
|---|---|---|---|---|---|---|---|
| | | VD (V) | VL (V) | Image evaluation | VD (V) | VL (V) | Image evaluation |
| Ex. 21 | Good | −805 | −95 | Good | −750 | −90 | Image blurring occurred. |
| Ex. 22 | Good | −810 | −95 | Good | −770 | −90 | Image blurring occurred. |
| Ex. 23 | Good | −820 | −90 | Good | −785 | −85 | Image blurring occurred. |
| Ex. 24 | Good | −820 | −90 | Good | −785 | −90 | Image blurring occurred. |
| Ex. 25 | Good | −825 | −90 | Good | −785 | −90 | Image blurring occurred. |
| Ex. 26 | Good | −805 | −100 | Good | −755 | −105 | Image blurring occurred. |
| Ex. 27 | Good | −830 | −100 | Good | −790 | −105 | Good |
| Ex. 28 | Good | −835 | −95 | Good | −810 | −100 | Good |
| Ex. 29 | Good | −830 | −100 | Good | −805 | −105 | Good |
| Ex. 30 | Good | −835 | −100 | Good | −810 | −110 | Good |
| Comp. Ex. 15 | Black stripes appeared. | −795 | −95 | Image blurring occurred. | −735 | −85 | Image blurring occurred. Toner deposition of background took place. |
| Comp. Ex. 16 | Black stripes appeared. | −770 | −125 | Image blurring occurred. | −705 | −155 | Image blurring occurred. Toner deposition of background took place. |
| Comp. Ex. 17 | Black stripes appeared. | −765 | −135 | Image blurring occurred. | −705 | −175 | Image blurring occurred. Toner deposition of background took place. |
| Comp. | Black stripes | −790 | −95 | Image | −730 | −90 | Image blurring |

TABLE 5-continued

| | Image Evaluation after | After Making of 50,000 Copies | | | After Making of 100,000 Copies | | |
|---|---|---|---|---|---|---|---|
| | Intermission of 24 Hours | VD (V) | VL (V) | Image evaluation | VD (V) | VL (V) | Image evaluation |
| Ex. 18 | appeared. | | | blurring occurred. | | | occurred. Toner deposition of background took place. |
| Comp. Ex. 19 | Black stripes appeared. | −765 | −135 | Image blurring occurred. | −710 | −180 | Image blurring occurred. Toner deposition of background took place. |
| Comp. Ex. 20 | Black stripes appeared. | −795 | −95 | Image blurring occurred. | −740 | −95 | Image blurring occurred. Toner deposition of background took place. |
| Comp. Ex. 21 | Black stripes appeared. | −820 | −170 | Image blurring occurred. | −795 | −250 | Image blurring occurred. Image density decreased. |
| Comp. Ex. 22 | Black stripes appeared. | −805 | −160 | Image blurring occurred. | −770 | −225 | Image blurring occurred. Image density decreased. |
| Comp. Ex. 23 | Black stripes appeared. | −790 | −135 | Image blurring occurred. | −745 | −180 | Image blurring occurred. Toner deposition of background took place. |

EXAMPLE 31

[Formation of Intermediate Layer]

A mixture of the following components was dispersed in a ball mill for 72 hours:

| | Parts by Weight |
|---|---|
| Titanium oxide (Trademark "CR-EL", made by Ishihara Sangyo Kaisha, Ltd.) | 160 |
| Alkyd resin (Trademark "Beckolite M6401-50-S", made by Dainippon Ink & Chemicals, Incorporated.) (solid content: 50%) | 36 |
| Melamine resin (Trademark "Super Beckamine L-121-60", made by Dainippon Ink & Chemicals, Incorporated.) (solid content: 60%) | 20 |
| Methyl ethyl ketone | 100 |

With the addition of 80 parts by weight of methyl ethyl ketone to the above prepared mixture, dispersion was further continued for 2 hours, so that a coating liquid for an intermediate layer was prepared. The thus obtained intermediate layer coating liquid was coated on the surface of an aluminum cylinder with a length of 370.5 mm and a diameter of 80 mm, and dried at 130° C. for minutes, so that an intermediate layer with a thickness of 2.5 μm was provided on the electroconductive support.

[Formation of Charge Generation Layer]

10 parts by weight of a trisazo pigment of the following formula (IV) were added to a resin solution prepared by dissolving 4 parts by weight of a polyvinyl butyral (Trademark "BM-2", made by Sekisui Chemical Co., Ltd.) in 150 parts by weight of cyclohexanone, and the mixture was dispersed in a ball mill for 48 hours.

(IV)

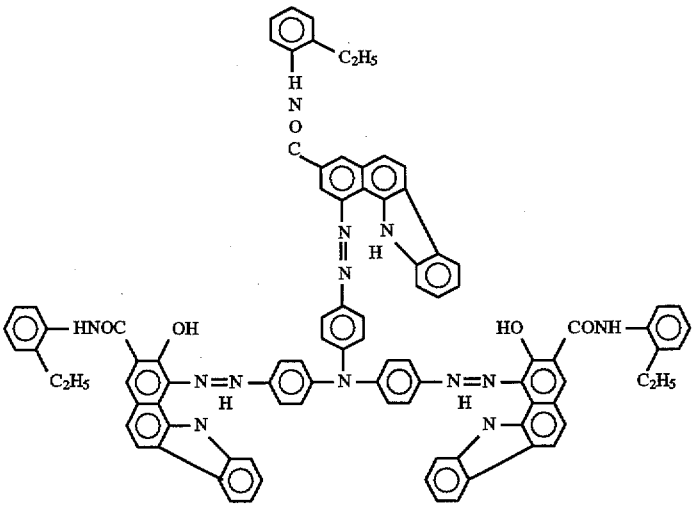

48 hours later, the mixture was further dispersed for 3 hours with the addition thereto of 210 parts by weight of cyclohexanone, so that a coating liquid for a charge generation layer was obtained. The thus obtained charge generation layer coating liquid was coated on the intermediate layer and dried at 130° C. for 10 minutes, so that a charge generation layer with a thickness of 0.2 μm was provided on the intermediate layer.

[Formation of Charge Transport Layer]

The following components were dissolved in 90 parts by weight of dichloromethane, so that a coating liquid for a charge transport layer was prepared:

| | Parts by Weight |
|---|---|
| Charge transporting material with the following formula (V): | 7 |
| 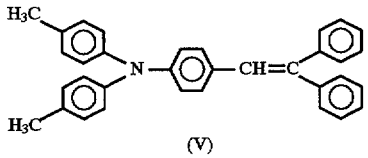 (V) | |
| Polycarbonate (Trademark "Panlite C-1400", made by Teijin Chemicals Ltd.) | 10 |
| Phenothiazine | 0.07 |
| Silicone oil (Trademark "KF-50", made by Shin-Etsu Chemical Co., Ltd.) | 0.002 |

The thus obtained charge transport layer coating liquid was coated on the charge generation layer and dried at 120° C. for 20 minutes, so that a charge transport layer with a thickness of 25 μm was provided on the charge generation layer.

[Formation of Protective Layer]

20 parts by weight of polycarbonate (Trademark "Panlite C-1400", made by Teijin Chemicals Ltd.), 10 parts by weight of the charge transporting material of formula (V), and 1 part by weight of o-terphenyl (available from Tokyo Kasei Kogyo Co., Ltd.) were dissolved in 500 parts by weight of monochlorobenzene, so that a coating liquid for a protective layer was prepared.

The thus prepared protective layer coating liquid was coated on the charge transport layer by spray coating and dried, whereby a protective layer with a thickness of 4 μm was provided on the charge transport layer.

Thus, an electrophotographic photoconductor No. 31 according to the present invention was obtained.

EXAMPLE 32

The procedure for preparation of the electrophotographic photoconductor No. 31 according to the present invention in Example 31 was repeated except that o-terphenyl for use in the protective layer coating liquid in Example 31 was replaced by compound No. (I)-41, and the charge transporting material of formula (V) for use in the protective layer coating liquid in Example 31 was replaced by the following charge transporting material of formula (VIII):

(VIII)

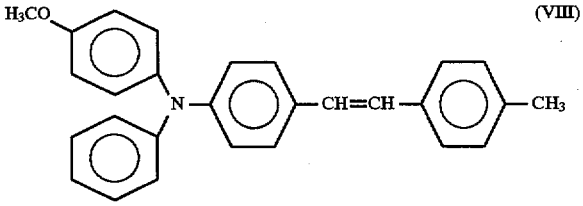

Thus, an electrophotographic photoconductor No. 32 according to the present invention was obtained.

EXAMPLES 33 TO 35

The procedure for preparation of the electrophotographic photoconductor No. 32 according to the present invention in Example 32 was repeated except that the compound No. (I)-41 for use in the protective layer coating liquid in Example 32 was replaced by compounds Nos. (I)-12, (I)-34 and (I)-52, respectively in Examples 33, 34 and 35, as shown in Table 6.

Thus, electrophotographic photoconductors Nos. 33 to 35 according to the present invention were obtained.

Comparative Example 24

The procedure for preparation of the electrophotographic photoconductor No. 31 according to the present invention in Example 31 was repeated except that o-terphenyl in an amount of 1 part by weight for use in the protective layer coating liquid in Example 31 was not employed.

Thus, a comparative electrophotographic photoconductor No. 24 was obtained.

Comparative Examples 25 to 28

The procedure for preparation of the comparative electrophotographic photoconductor No. 24 in Comparative Example 24 was repeated except that the charge transporting material of formula (V) for use in the protective layer coating liquid in Comparative Example 24 was replaced by the following charge transporting materials (VI), (VII), (VIII) and (IX) respectively in Comparative Examples 25, 26, 27 and 28.

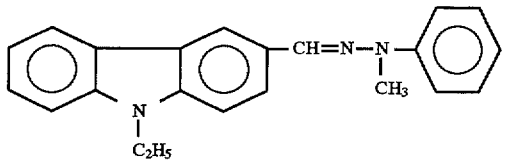
(VI)

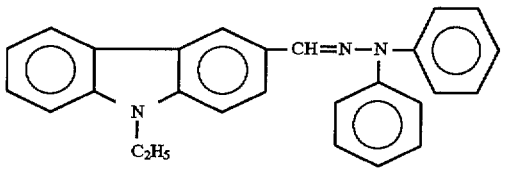
(VII)

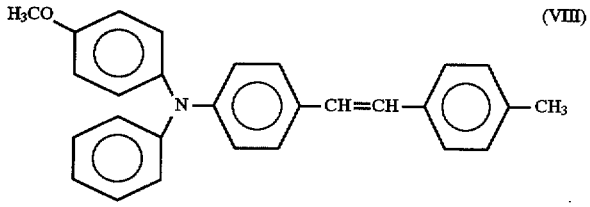
(VIII)

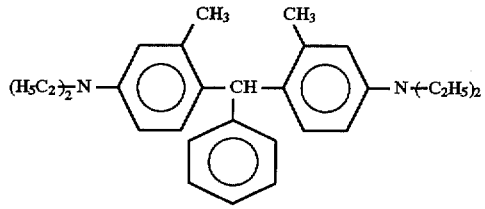
(IX)

Thus, comparative electrophotographic photoconductors Nos. 25 to 28 were obtained.

Comparative Example 29

The procedure for preparation of the comparative electrophotographic photoconductor No. 24 in Comparative Example 24 was repeated except that 2,6-di-tert-butyl-p-cresol (Trademark "Nocrac 200", made by Ouchi-Shinko Chemical Industrial Co., Ltd.) in an amount of 0.5 parts by weight was added to the formulation for the protective layer coating liquid in Comparative Example 24.

Thus, a comparative electrophotographic photoconductor No. 29 was obtained.

Comparative Example 30

The procedure for preparation of the comparative electrophotographic photoconductor No. 24 in Comparative Example 24 was repeated except that commercially available bis(2,2,6,6-tetramethyl-4-piperidyl)sebacate (Trademark "Sanol LS-770", made by Sankyo Company, Ltd.) in an amount of 0.5 parts by weight was added to the formulation for the protective layer coating liquid in Comparative Example 24.

Thus, a comparative electrophotographic photoconductor No. 30 was obtained.

Comparative Example 31

The procedure for preparation of the comparative electrophotographic photoconductor No. 24 in Comparative Example 24 was repeated except that zinc stearate (available from Kanto Chemical Co., Inc.) in an amount of 0.5 parts by weight was added to the formulation for the protective layer coating liquid in Comparative Example 24.

Thus, a comparative electrophotographic photoconductor No. 31 was obtained.

EXAMPLE 36

The procedure for preparation of the comparative electrophotographic photoconductor No. 24 in Comparative Example 24 was repeated except that the polycarbonate (Trademark "Panlite C-1400", made by Teijin Chemicals Ltd.) for use in the protective layer coating liquid in Comparative Example 24 was replaced by a Z type polycarbonate with a viscosity-average molecular weight of 50,000.

Thus, an electrophotographic photoconductors No. 36 according to the present invention was obtained.

EXAMPLE 37

The procedure for preparation of the electrophotographic photoconductor No. 36 according to the present invention in Example 36 was repeated except that compound No. (I)-40 in an amount of 1 part by weight was added to the formulation for the protective layer coating liquid in Example 36.

Thus, an electrophotographic photoconductor No. 37 according to the present invention was obtained.

EXAMPLES 38 TO 40

The procedure for preparation of the electrophotographic photoconductor No. 37 according to the present invention in Example 37 was repeated except that the compound No. (I)-40 for use in the protective layer coating liquid in Example 37 was replaced by compounds Nos. (I)-12, (I)-34 and (I)-52, respectively in Examples 38, 39 and 40, as shown in Table 6.

Thus, electrophotographic photoconductors Nos. 38 to 40 according to the present invention were obtained.

Comparative Example 32

The procedure for preparation of the electrophotographic photoconductor No. 36 according to the present invention in Example 36 was repeated except that the charge transporting material of formula (V) for use in the protective layer coating liquid in Example 36 was replaced by the following charge transporting material of formula (VI):

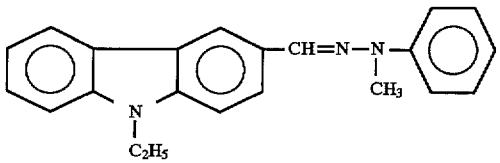
(VI)

Thus, a comparative electrophotographic photoconductor No. 32 was obtained.

The oxygen transmission coefficient of the protective layer of each electrophotographic photoconductor, and the charge mobility of the charge transporting material employed in each protective layer were measured by the previously mentioned methods. The results are shown in Table 6.

The electrostatic properties of each photoconductor and quality of images produced by each of the photoconductors Nos. 31 to 40 and comparative electrophotographic photoconductors Nos. 24 to 32 were evaluated in the same manner as in Example 21, using a commercially available copying machine (Trademark "IMAGIO MF530", made by Ricoh Company, Ltd.).

The results are shown in Table 7.

TABLE 6

| | CTM for use in Protective Layer | Added Compound in Protective Layer | Oxygen Transmission Coefficient of Protective Layer ($cm^3 \cdot cm/cm^2 \cdot sec \cdot cmHg$) | Charge Mobility of CTM in CTL ($cm^2/V \cdot s$) |
|---|---|---|---|---|
| Ex. 31 | (V) | o-terphenyl | $3.51 \times 10^{-11}$ | $3.1 \times 10^{-5}$ |
| Ex. 32 | (VIII) | (I)-41 | $3.56 \times 10^{-11}$ | $1.8 \times 10^{-5}$ |
| Ex. 33 | (VIII) | (I)-12 | $3.26 \times 10^{-11}$ | $1.8 \times 10^{-5}$ |
| Ex. 34 | (VIII) | (I)-34 | $3.28 \times 10^{-11}$ | $1.8 \times 10^{-5}$ |
| Ex. 35 | (VIII) | (I)-52 | $3.30 \times 10^{-11}$ | $1.8 \times 10^{-5}$ |
| Ex. 36 | (V) | — | $2.93 \times 10^{-11}$ | $3.1 \times 10^{-5}$ |
| Ex. 37 | (V) | (I)-40 | $2.09 \times 10^{-11}$ | $3.1 \times 10^{-5}$ |
| Ex. 38 | (V) | (I)-12 | $1.92 \times 10^{-11}$ | $3.1 \times 10^{-5}$ |
| Ex. 39 | (V) | (I)-34 | $1.95 \times 10^{-11}$ | $3.1 \times 10^{-5}$ |
| Ex. 40 | (V) | (I)-52 | $1.95 \times 10^{-11}$ | $3.1 \times 10^{-5}$ |
| Comp. Ex. 24 | (V) | — | $4.98 \times 10^{-11}$ | $3.1 \times 10^{-5}$ |
| Comp. Ex. 25 | (VI) | — | $1.63 \times 10^{-11}$ | $1.8 \times 10^{-6}$ |

TABLE 6-continued

| | CTM for use in Protective Layer | Added Compound in Protective Layer | Oxygen Transmission Coefficient of Protective Layer ($cm^3 \cdot cm/cm^2 \cdot sec \cdot cmHg$) | Charge Mobility of CTM in CTL ($cm^2/V \cdot s$) |
|---|---|---|---|---|
| Comp. Ex. 26 | (VII) | — | $1.94 \times 10^{-11}$ | $5.6 \times 10^{-6}$ |
| Comp. Ex. 27 | (VIII) | — | $4.81 \times 10^{-11}$ | $1.8 \times 10^{-5}$ |
| Comp. Ex. 28 | (IX) | — | $1.93 \times 10^{-11}$ | $2.7 \times 10^{-6}$ |
| Comp. Ex. 29 | (V) | 2,6-di-tert-butyl-p-cresol | $4.80 \times 10^{-11}$ | $3.1 \times 10^{-5}$ |
| Comp. Ex. 30 | (V) | Bis(2,2,6,6-tetramethyl-4-piperidyl)-sebacate | $4.80 \times 10^{-11}$ | $3.1 \times 10^{-5}$ |
| Comp. Ex. 31 | (V) | Zinc stearate | $4.85 \times 10^{-11}$ | $3.1 \times 10^{-5}$ |
| Comp. Ex. 32 | (VI) | — | $1.42 \times 10^{-11}$ | $1.8 \times 10^{-6}$ |

TABLE 7

| | Image Evaluation after Intermission of 24 Hours | After Making of 50,000 Copies VD (V) | VL (V) | Image evaluation | After Making of 100,000 Copies VD (V) | VL (V) | Image Evaluation |
|---|---|---|---|---|---|---|---|
| Ex. 31 | Good | −800 | −95 | Good | −745 | −90 | Image blurring occurred. Toner deposition of background took place. |
| Ex. 32 | Good | −805 | −95 | Good | −760 | −95 | Image blurring occurred. |
| Ex. 33 | Good | −815 | −90 | Good | −780 | −90 | Image blurring occurred. |
| Ex. 34 | Good | −815 | −95 | Good | −780 | −90 | Image blurring occurred. |
| Ex. 35 | Good | −815 | −95 | Good | −780 | −90 | Image blurring occurred. |
| Ex. 36 | Good | −800 | −100 | Good | −750 | −95 | Image blurring occurred. |
| Ex. 37 | Good | −825 | −100 | Good | −790 | −95 | Good |
| Ex. 38 | Good | −830 | −95 | Good | −805 | −90 | Good |
| Ex. 39 | Good | −830 | −100 | Good | −805 | −95 | Good |
| Ex. 40 | Good | −830 | −100 | Good | −805 | −95 | Good |
| Comp. Ex. 24 | Black stripes appeared. | −800 | −95 | Image blurring occurred. | −740 | −90 | Image blurring occurred. Toner deposition of background took place. |
| Comp. Ex. 25 | Black stripes appeared. | −775 | −120 | Image blurring occurred. | −710 | −150 | Image blurring occurred. Toner deposition of background took place. |
| Comp. Ex. 26 | Black stripes appeared. | −770 | −125 | Image blurring occurred. | −710 | −165 | Image blurring occurred. Toner deposition of background took place. |
| Comp. Ex. 27 | Black stripes appeared. | −790 | −90 | Image blurring occurred. | −735 | −95 | Image blurring occurred. Toner deposition of background took place. |
| Comp. Ex. 28 | Black stripes appeared. | −770 | −125 | Image blurring occurred. | −715 | −170 | Image blurring occurred. Toner deposition of background took place. |
| Comp. Ex. 29 | Black stripes appeared. | −795 | −90 | Image blurring occurred. | −740 | −95 | Image blurring occurred. Toner deposition of background took place. |
| Comp. Ex. 30 | Black stripes appeared. | −810 | −160 | Image blurring occurred. | −785 | −240 | Image blurring occurred. Image density decreased. |
| Comp. Ex. 31 | Black stripes appeared. | −800 | −150 | Image blurring occurred. | −765 | −210 | Image blurring occurred. Image density decreased. |
| Comp. Ex. 32 | Black stripes appeared. | −785 | −125 | Image blurring occurred. | −740 | −170 | Image blurring occurred. Toner deposition of background took place. |

As can be seen from the results shown in Tables 4 to 7, even when the electrophotographic photoconductors according to the present invention are repeatedly subjected to the copying operation, high quality images can be produced without image deterioration, in particular, without image blur.

As previously explained, the electrostatic properties of the electrophotographic photoconductors according to the present invention are stable in the repeated copying operations, and high quality images can be constantly obtained without image blur, black stripes or toner deposition on the background.

In addition, the charging characteristics of the photoconductors of the present invention are excellent even after the photoconductors are exposed to oxidizing gases such as ozone and $NO_x$, so that the photoconductors of the present invention are regarded as excellent in terms of the gas resistance.

Japanese Patent Application No. 6-290468 filed Oct. 31, 1994, Japanese Patent Application No. 7-037651 filed Feb. 2, 1995, and Japanese Patent Application filed Oct. 24, 1995 are hereby incorporated by reference.

What is claimed is:

1. An electrophotographic photoconductor, comprising an electroconductive support, and a photoconductive layer formed thereon as a surface top layer of said photoconductor, said photoconductive layer comprising a charge generating material and a charge transporting material, and having an oxygen transmission coefficient of $2.0\times10^{-11}$ $cm^3$•cm/$cm^2$•s•cmHg or less, said charge transporting material having a charge mobility of $1\times10^{-5}$ $cm^2$/V•s or more at an electric field strength of $5\times10^5$ V/cm.

2. The electrophotographic photoconductor as claimed in claim 1, wherein said photoconductive layer further comprises a compound of formula (I):

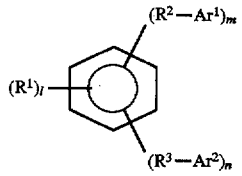

(I)

wherein $R^1$ is a lower alkyl group; $R^2$ and $R^3$ each is methylene group or ethylene group which may have a substituent; $Ar^1$ and $Ar^2$ each is an aryl group which may have a substituent; and l is an integer of 0 to 4, and each of m and n is an integer of 0 to 2 provided that $m+n\geqq2$ and $l+m+n\leqq6$.

3. The electrophotographic photoconductor as claimed in claim 2, wherein said lower alkyl group represented by $R^1$ in formula (I) has 1 to 6 carbon atoms.

4. The electrophotographic photoconductor as claimed in claim 2, wherein said substituent of methylene group or ethylene group represented by $R^2$ or $R^3$ is selected from the group consisting of methyl group, ethyl group, benzyl group, and phenyl group.

5. The electrophotographic photoconductor as claimed in claim 2, wherein said aryl group represented by $Ar^1$ or $Ar^2$ is selected from the group consisting of phenyl group, biphenyl group and naphthyl group.

6. The electrophotographic photoconductor as claimed in claim 2, wherein said substituent of said aryl group represented by $Ar^1$ or $Ar^2$ is selected from the group consisting of methyl group, ethyl group, propyl group, and benzyl group.

7. The electrophotographic photoconductor as claimed in claim 1, wherein said photoconductive layer further comprises a compound of formula (II):

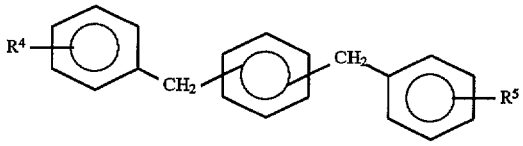

(II)

wherein $R^4$ or $R^5$ each is a lower alkyl group.

8. The electrophotographic photoconductor as claimed in claim 7, wherein said lower alkyl group represented by $R^4$ or $R^5$ in formula (II) has 1 to 6 carbon atoms.

9. The electrophotographic photoconductor as claimed in claim 1, wherein said charge transporting material comprises a compound of formula (III):

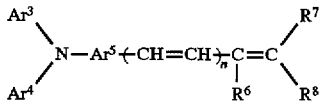

(III)

wherein $Ar^3$ and $Ar^4$ each is an aryl group which may have a substituent, or a heterocyclic group which may have a substituent; $R^6$, $R^7$ and $R^8$ each is a hydrogen atom, an alkyl group which may have a substituent, an alkoxyl group which may have a substituent, an aryl group which may have a substituent, or a heterocyclic group which may have a substituent, and $R^7$ and $R^8$ may form a ring in combination; $Ar^5$ is an arylene group which may have a substituent; and n is an integer of 0 or 1.

10. The electrophotographic photoconductor as claimed in claim 9, wherein said aryl group represented by $Ar^3$, $Ar^4$, $R^6$, $R^7$ or $R^8$ is selected from the group consisting of phenyl group, naphthyl group, anthryl group, and pyrenyl group.

11. The electrophotographic photoconductor as claimed in claim 9, wherein said heterocyclic group represented by $Ar^3$, $Ar^4$, $R^6$, $R^7$ or $R^8$ is selected from the group consisting of pyridyl group, pyrimidyl group, pyrazinyl group, triazinyl group, furyl group, pyrrolyl group, thienyl group, quinolyl group, thiazolyl group, carbazolyl group, benzimidazolyl group, benzothiazolyl group, coumarinyl group, benzofuranyl group, indolyl group, pyrazolyl group, imidazolyl group, oxazolyl group, thiazolyl group, benzotetrahydrofuryl group, and fluorenyl group.

12. The electrophotographic photoconductor as claimed in claim 9, wherein said alkyl group represented by $R^6$, $R^7$ or $R^8$ is a straight chain or branched chain alkyl group having 1 to 6 carbon atoms, which is selected from the group consisting of methyl group, ethyl group, n-propyl group, i-propyl group, t-butyl group, i-butyl group and n-butyl group.

13. The electrophotographic photoconductor as claimed in claim 9, wherein said alkoxyl group represented by $R^6$, $R^7$ or $R^8$ is selected from the group consisting of methoxy group, i-propoxy group, n-propoxy group, t-butoxy group, n-butoxy group, s-butoxy group and i-butoxy group.

14. The electrophotographic photoconductor as claimed in claim 9, wherein said arylene group represented by $Ar^5$ is selected from the group consisting of phenylene group, naphthylene group, anthrylene group, pyrenylene group, biphenylene group, fluorenylene group and pyridylene group.

15. The electrophotographic photoconductor as claimed in claim 9, wherein said substituent of aryl group, heterocyclic group, alkyl group, alkoxyl group or arylene group in formula (III) is selected from the group consisting of fluorine atom, hydroxyl group, cyano group, an alkyl group having 1 to 4 carbon atoms, an alkoxyl group having 1 to 4 carbon atoms, a phenyl group which may be substituted by an alkyl group or an alkoxyl group, a halogen atom, benzyl group, and amino group.

16. An electrophotographic photoconductor, comprising an electroconductive support, a photoconductive layer formed thereon which comprises a charge generation layer comprising a charge generating material, and a charge transport layer comprising a charge transporting material formed on said charge generation layer, serving as a surface top layer of said photoconductor, said charge transport layer having an oxygen transmission coefficient of $2.0\times10^{-11}$ $cm^3$•cm/$cm^2$•s•cmHg or less, said charge transporting material having a charge mobility of $1\times10^{-5}$ $cm^2$/V•s or more at an electric field strength of $5\times10^5$ V/cm.

17. The electrophotographic photoconductor as claimed in claim 16, wherein said charge transport layer further comprises a compound of formula (I):

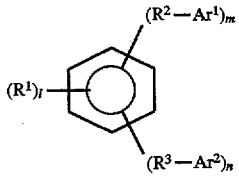

(I)

wherein $R^1$ is a lower alkyl group; $R^2$ and $R^3$ each is methylene group or ethylene group which may have a substituent; $Ar^1$ and $Ar^2$ each is an aryl group which may have a substituent; and l is an integer of 0 to 4, and each of m and n is an integer of 0 to 2 provided that $m+n\geqq2$ and $l+m+n\leqq6$.

18. The electrophotographic photoconductor as claimed in claim 17, wherein said lower alkyl group represented by $R^1$ in formula (I) has 1 to 6 carbon atoms.

19. The electrophotographic photoconductor as claimed in claim 17, wherein said substituent of methylene group or ethylene group represented by $R^2$ or $R^3$ is selected from the group consisting of methyl group, ethyl group, benzyl group, and phenyl group.

20. The electrophotographic photoconductor as claimed in claim 17, wherein said aryl group represented by $Ar^1$ or $Ar^2$ is selected from the group consisting of phenyl group, biphenyl group and naphthyl group.

21. The electrophotographic photoconductor as claimed in claim 17, wherein said substituent of said aryl group represented by $Ar^1$ or $Ar^2$ is selected from the group consisting of methyl group, ethyl group, propyl group, and benzyl group.

22. The electrophotographic photoconductor as claimed in claim 16, wherein said charge transport layer further comprises a compound of formula (II):

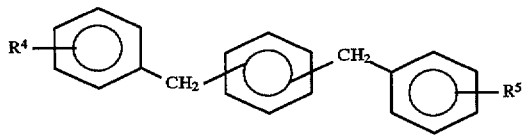

(II)

wherein $R^4$ or $R^5$ each is a lower alkyl group.

23. The electrophotographic photoconductor as claimed in claim 22, wherein said lower alkyl group represented by $R^4$ or $R^5$ in formula (II) has 1 to 6 carbon atoms.

24. The electrophotographic photoconductor as claimed in claim 16, wherein said charge transporting material comprises a compound of formula (III):

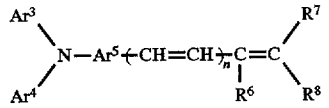

(III)

wherein $Ar^3$ and $Ar^4$ each is an aryl group which may have a substituent, or a heterocyclic group which may have a substituent; $R^6$, $R^7$ and $R^8$ each is a hydrogen atom, an alkyl group which may have a substituent, an alkoxyl group which may have a substituent, an aryl group which may have a substituent, or a heterocyclic group which may have a substituent, and $R^7$ and $R^8$ may form a ring in combination; $Ar^5$ is an arylene group which may have a substituent; and n is an integer of 0 or 1.

25. The electrophotographic photoconductor as claimed in claim 24, wherein said aryl group represented by $Ar^3$, $Ar^4$, $R^6$, $R^7$ or $R^8$ is selected from the group consisting of phenyl group, naphthyl group, anthryl group, and pyrenyl group.

26. The electrophotographic photoconductor as claimed in claim 24, wherein said heterocyclic group represented by $Ar^3$, $Ar^4$, $R^6$, $R^7$ or $R^8$ is selected from the group consisting of pyridyl group, pyrimidyl group, pyrazinyl group, triazinyl group, furyl group, pyrrolyl group, thienyl group, quinolyl group, thiazolyl group, carbazolyl group, benzimidazolyl group, benzothiazolyl group, coumarinyl group, benzofuranyl group, indolyl group, pyrazolyl group, imidazolyl group, oxazolyl group, thiazolyl group, benzotetrahydrofuryl group, and fluorenyl group.

27. The electrophotographic photoconductor as claimed in claim 24, wherein said alkyl group represented by $R^6$, $R^7$ or $R^8$ is a straight chain or branched chain alkyl group having 1 to 6 carbon atoms, which is selected from the group consisting of methyl group, ethyl group, n-propyl group, i-propyl group, t-butyl group, i-butyl group and n-butyl group.

28. The electrophotographic photoconductor as claimed in claim 24, wherein said alkoxyl group represented by $R^6$, $R^7$ or $R^8$ is selected from the group consisting of methoxy group, i-propoxy group, n-propoxy group, t-butoxy group, n-butoxy group, s-butoxy group and i-butoxy group.

29. The electrophotographic photoconductor as claimed in claim 24, wherein said arylene group represented by $Ar^5$ is selected from the group consisting of phenylene group, naphthylene group, anthrylene group, pyrenylene group, biphenylene group, fluorenylene group and pyridylene group.

30. The electrophotographic photoconductor as claimed in claim 24, wherein said substituent of aryl group, heterocyclic group, alkyl group, alkoxyl group or arylene group in formula (III) is selected from the group consisting of fluorine atom, hydroxyl group, cyano group, an alkyl group having 1 to 4 carbon atoms, an alkoxyl group having 1 to 4 carbon atoms, a phenyl group which may be substituted by an alkyl group or an alkoxyl group, a halogen atom, benzyl group, and amino group.

31. An electrophotographic photoconductor, comprising an electroconductive support, a photoconductive layer formed thereon which comprises a charge generating material and a charge transporting material, and a protective layer comprising a charge transporting material formed on said photoconductive layer, serving as a surface top layer of said photoconductor, said protective layer having an oxygen transmission coefficient of $2.0\times10^{-11}$ $cm^3$•cm/$cm^2$•s•cmHg or less, said charge transporting material in said protective layer having a charge mobility of $1\times10^{-5}$ $cm^3$/V•s or more at an electric field strength of $5\times10^5$ V/cm.

32. The electrophotographic photoconductor as claimed in claim 31, wherein said photoconductor comprises a charge generation layer comprising said charge generating material, and a charge transport layer comprising said charge transporting material formed on said charge generation layer.

33. The electrophotographic photoconductor as claimed in claim 31, wherein said protective layer further comprises a compound of formula (I):

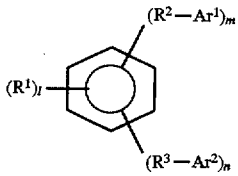

(I)

wherein $R^1$ is a lower alkyl group; $R^2$ and $R^3$ each is methylene group or ethylene group which may have a substituent; $Ar^1$ and $Ar^2$ each is an aryl group which may have a substituent; and l is an integer of 0 to 4, and each of m and n is an integer of 0 to 2 provided that $m+n \geqq 2$ and $l+m+n \leqq 6$.

34. The electrophotographic photoconductor as claimed in claim 33, wherein said lower alkyl group represented by $R^1$ in formula (I) has 1 to 6 carbon atoms.

35. The electrophotographic photoconductor as claimed in claim 33, wherein said substituent of methylene group or ethylene group represented by $R^2$ or $R^3$ is selected from the group consisting of methyl group, ethyl group, benzyl group, and phenyl group.

36. The electrophotographic photoconductor as claimed in claim 33, wherein said aryl group represented by $Ar^1$ or $Ar^2$ is selected from the group consisting of phenyl group, biphenyl group and naphthyl group.

37. The electrophotographic photoconductor as claimed in claim 33, wherein said substituent of said aryl group represented by $Ar^1$ or $Ar^2$ is selected from the group consisting of methyl group, ethyl group, propyl group, and benzyl group.

38. The electrophotographic photoconductor as claimed in claim 31, wherein said protective layer further comprises a compound of formula (II):

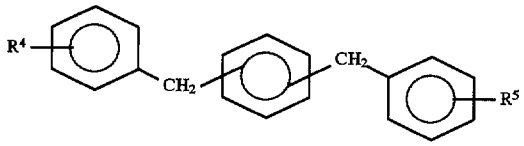

(II)

wherein $R^4$ or $R^5$ each is a lower alkyl group.

39. The electrophotographic photoconductor as claimed in claim 38, wherein said lower alkyl group represented by $R^4$ or $R^5$ in formula (II) has 1 to 6 carbon atoms.

40. The electrophotographic photoconductor as claimed in claim 31, wherein said charge transporting material for use in said protective layer comprises a compound of formula (III):

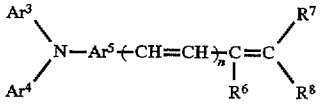

(III)

wherein $Ar^3$ and $Ar^4$ each is an aryl group which may have a substituent, or a heterocyclic group which may have a substituent; $R^6$, $R^7$ and $R^8$ each is a hydrogen atom, an alkyl group which may have a substituent, an alkoxyl group which may have a substituent, an aryl group which may have a substituent, or a heterocyclic group which may have a substituent, and $R^7$ and $R^8$ may form a ring in combination; $Ar^5$ is an arylene group which may have a substituent; and n is an integer of 0 or 1.

41. The electrophotographic photoconductor as claimed in claim 40, wherein said aryl group represented by $Ar^3$, $Ar^4$, $R^6$, $R^7$ or $R^8$ is selected from the group consisting of phenyl group, naphthyl group, anthryl group, and pyrenyl group.

42. The electrophotographic photoconductor as claimed in claim 40, wherein said heterocyclic group represented by $Ar^3$, $Ar^4$, $R^6$, $R^7$ or $R^8$ is selected from the group consisting of pyridyl group, pyrimidyl group, pyrazinyl group, triazinyl group, furyl group, pyrrolyl group, thienyl group, quinolyl group, thiazolyl group, carbazolyl group, benzimidazolyl group, benzothiazolyl group, coumarinyl group, benzofuranyl group, indolyl group, pyrazolyl group, imidazolyl group, oxazolyl group, thiazolyl group, benzotetrahydrofuryl group, and fluorenyl group.

43. The electrophotographic photoconductor as claimed in claim 40, wherein said alkyl group represented by $R^6$, $R^7$ or $R^8$ is a straight chain or branched chain alkyl group having 1 to 6 carbon atoms, which is selected from the group consisting of methyl group, ethyl group, n-propyl group, i-propyl group, t-butyl group, i-butyl group and n-butyl group.

44. The electrophotographic photoconductor as claimed in claim 40, wherein said alkoxyl group represented by $R^6$, $R^7$ or $R^8$ is selected from the group consisting of methoxy group, i-propoxy group, n-propoxy group, t-butoxy group, n-butoxy group, s-butoxy group and i-butoxy group.

45. The electrophotographic photoconductor as claimed in claim 40, wherein said arylene group represented by $Ar^5$ is selected from the group consisting of phenylene group, naphthylene group, anthrylene group, pyrenylene group, biphenylene group, fluorenylene group and pyridylene group.

46. The electrophotographic photoconductor as claimed in claim 40, wherein said substituent of aryl group, heterocyclic group, alkyl group, alkoxyl group or arylene group in formula (III) is selected from the group consisting of fluorine atom, hydroxyl group, cyano group, an alkyl group having 1 to 4 carbon atoms, an alkoxyl group having 1 to 4 carbon atoms, a phenyl group which may be substituted by an alkyl group or an alkoxyl group, a halogen atom, benzyl group, and amino group.

* * * * *

UNITED STATES PATENT AND TRADEMARK OFFICE

CERTIFICATE OF CORRECTION

PATENT NO. : 5,665,500

DATED : SEPTEMBER 9, 1997

INVENTOR(S) : YASUO SUZUKI

It is certified that error appears in the above-indentified patent and that said Letters Patent is hereby corrected as shown below:

Column 1, line 19, "developed recent years," should read --developed in recent years,--.

Column 36, line 32, "such as decrease" should read --such as a decrease--.

Column 86, line 34, "photoconductors No. 16" should read --photoconductor No. 16--.

Column 90, line 42, "compounds Nos." should read --compound Nos.--.

Column 92, line 11, "photoconductors No. 26" should read --photoconductor No. 26--.
line 29, "compound Nos." should read --compound Nos.--.

Column 96, line 36, "for minutes," should read --for 20 minutes--.

Column 98, line 51, "compounds Nos." should read --compound Nos.--.

Column 100, line 17, "photoconductors No. 36" should read --photoconductor No. 36--;
line 34, "compounds Nos." should read --compound Nos.--.

UNITED STATES PATENT AND TRADEMARK OFFICE

CERTIFICATE OF CORRECTION

PATENT NO. : 5,665,500
DATED : SEPTEMBER 9, 1997
INVENTOR(S) : YASUO SUZUKI

It is certified that error appears in the above-indentified patent and that said Letters Patent is hereby corrected as shown below:

Column 101, Table 6, line 19, "$2.09 \times 10^{-11}$" should read --$2.08 \times 10^{-11}$--.

Columns 101 and 102, Table 6, title of column 4, "Charge Mobility of CTM in CTL ($cm^2/V \cdot s$)" should read --Charge Mobility of CTM in Protective layer ($cm^2/V \cdot s$)--.

Signed and Sealed this

FourthDay of August, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,665,500

DATED : SEPTEMBER 9, 1997

INVENTOR(S) : YASUO SUZUKI

It is certified that error appears in the above-identified patent and that said Letters Patent is hereby corrected as shown below:

Column 29, Diagram # (I)-71

"

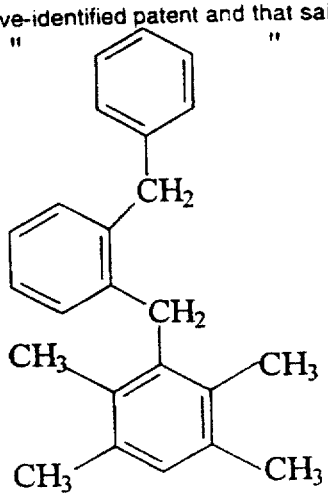

"

should read

--

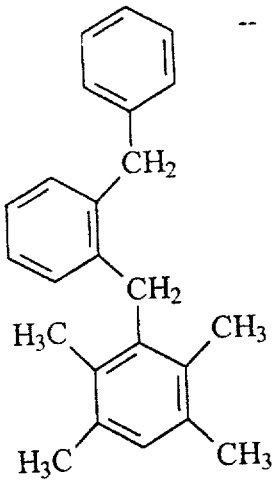

--

UNITED STATES PATENT AND TRADEMARK OFFICE

CERTIFICATE OF CORRECTION

PATENT NO. : 5,665,500

DATED : SEPTEMBER 9, 1997

INVENTOR(S) : YASUO SUZUKI

It is certified that error appears in the above-indentified patent and that said Letters Patent is hereby corrected as shown below:

Columns 77 and 78

" (IV) "

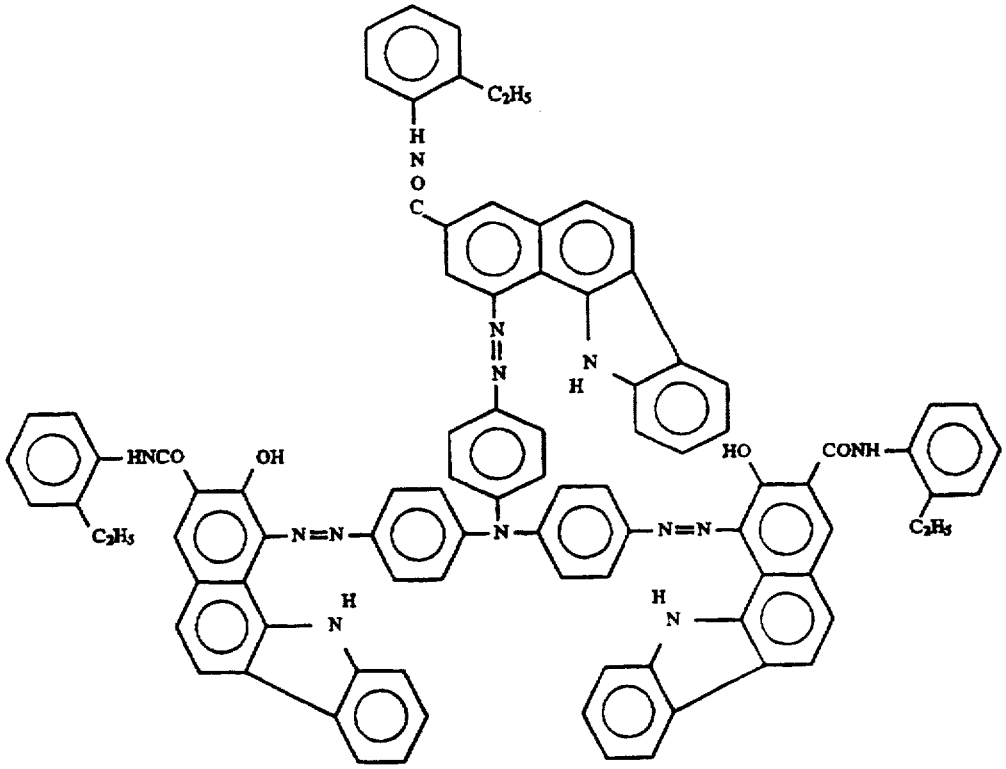

UNITED STATES PATENT AND TRADEMARK OFFICE

CERTIFICATE OF CORRECTION

PATENT NO. : 5,665,500

DATED : SEPTEMBER 9, 1997

INVENTOR(S) : YASUO SUZUKI

It is certified that error appears in the above-indentified patent and that said Letters Patent is hereby corrected as shown below:

Should read --

(IV) --

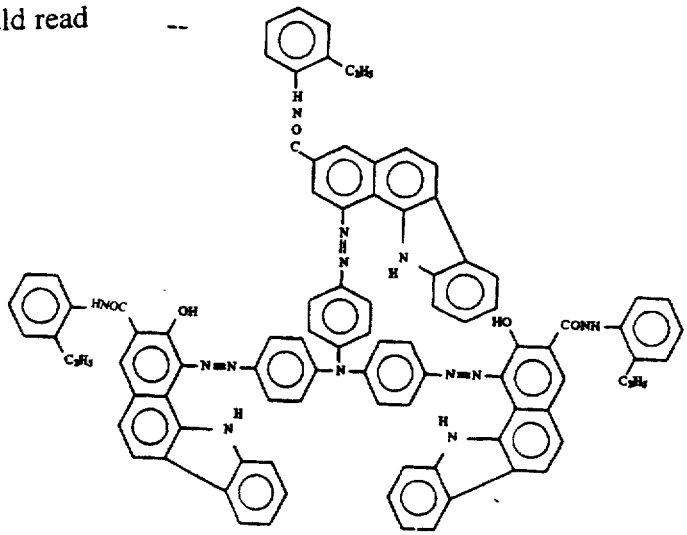

Signed and Sealed this

FourthDay of August, 1998

Bruce Lehman

*Attest:*

BRUCE LEHMAN

*Attesting Officer*

*Commissioner of Patents and Trademarks*